US007062943B2

(12) United States Patent
Parsons et al.

(10) Patent No.: US 7,062,943 B2
(45) Date of Patent: Jun. 20, 2006

(54) TWO-SIDED KEY RELEASE FOR HANDCUFF

(75) Inventors: Kevin Parsons, Appleton, WI (US); Lester Stener, Blain, MN (US)

(73) Assignee: Armament Systems & Procedures, Inc., Appleton, WI (US)

( * ) Notice: Subject to any disclaimer, the term of this patent is extended or adjusted under 35 U.S.C. 154(b) by 0 days.

(21) Appl. No.: 11/047,525

(22) Filed: Feb. 1, 2005

(65) Prior Publication Data

US 2005/0262892 A1 Dec. 1, 2005

Related U.S. Application Data

(62) Division of application No. 10/854,754, filed on May 26, 2004.

(51) Int. Cl.
*E05B 75/00* (2006.01)

(52) U.S. Cl. ..... 70/16

(58) Field of Classification Search ..... 70/14–19
See application file for complete search history.

(56) References Cited

U.S. PATENT DOCUMENTS

| | | | | |
|---|---|---|---|---|
| 1,157,135 | A | 10/1915 | Wesson et al. | |
| 1,531,451 | A * | 3/1925 | Neal | 70/16 |
| 1,579,830 | A * | 4/1926 | Murphy | 70/16 |
| 1,872,857 | A * | 8/1932 | Wesson et al. | 70/16 |
| 2,390,885 | A * | 12/1945 | Kelley | 70/16 |
| 2,510,294 | A * | 6/1950 | Rivolier | 70/16 |
| 2,570,662 | A * | 10/1951 | Gray | 70/16 |
| 2,759,349 | A * | 8/1956 | Mckee | 70/16 |
| 3,423,871 | A | 1/1969 | Foley | |
| 4,089,195 | A | 5/1978 | Lai | |
| 4,162,622 | A | 7/1979 | Daleo | |
| 4,249,401 | A | 2/1981 | Daleo | |
| 4,287,731 | A * | 9/1981 | Kruger | 70/16 |

(Continued)

*Primary Examiner*—Suzanne Dino Barrett
(74) *Attorney, Agent, or Firm*—Welsh & Katz, Ltd.

(57) ABSTRACT

The handcuff assembly includes a bow pivotally connected to a cheek plate frame assembly which includes a unitized frame that is die stamped from a metal plate and which is overmolded with a polymer overmold. The bow and arcuate cheek arms engage a wrist of a person to be restrained with an envelope of the bow being defined by a conic path with an increasing arc. The bow and cheek arms have rounded inner edge surfaces. The cheek arms have reinforcing ribs. The molded polymer covering surrounding the cheek arms provide a round on the inner edge of the cheek arms which engage a wrist. The unitized frame has interlocking tabs on folded side plates of a base frame. A flat is provided on an outer surface of the bow for lining up a point of contact with a wrist. A removable lockset assembly for locking a pawl relative to ratchet teeth on the bow and including a slideable lock bar is received in the base frame. A key receiving structure on each side of the lockset assembly is provided for receiving a key and enabling the key to turned in one direction only for first unlocking a double-lock, which prevents movement of the bow in either direction and for secondly, completely unlocking the handcuff by moving the pawl away from the bow and against a spring mechanism. A deflectable detent is provided on a lockset housing for releaseably locking the lockset assembly within the base frame of the molded cheek plate assembly. A swivel cup is fixed in the base frame of the cheek plate assembly prior to polymer overmolding and a swivel with a welded chain link mounted thereon and has a swivel pin which is received in the swivel cup.

28 Claims, 15 Drawing Sheets

U.S. PATENT DOCUMENTS 4,300,368 A * 11/1981 Sullivan ..... 70/16
4,314,466 A 2/1982 Harris ..... 70/16
4,509,346 A * 4/1985 Szczepanek ..... 70/16
4,574,600 A 3/1986 Moffett ..... 70/16
5,138,852 A 8/1992 Corcoran
5,205,142 A 4/1993 Kruger et al.
5,454,383 A 10/1995 Nebolon
5,479,943 A 1/1996 Kuhnell, III
5,598,723 A 2/1997 Ecker et al.
5,613,381 A 3/1997 Savage
5,660,064 A 8/1997 Ecker et al. ..... 70/16
5,697,231 A * 12/1997 Tobin, Jr. ..... 70/16
5,743,117 A * 4/1998 Woo et al. ..... 70/16
5,797,284 A 8/1998 Lurie
6,311,529 B1 11/2001 Kang
6,349,574 B1 2/2002 Lurie
6,361,480 B1 3/2002 Coram
6,484,536 B1 11/2002 Gould
6,574,998 B1 6/2003 Kwon ..... 70/16
6,588,240 B1 * 7/2003 Anderson ..... 70/16
6,619,077 B1 * 9/2003 Robinson ..... 70/16
6,672,116 B1 1/2004 Hilliard ..... 70/16
6,684,666 B1 * 2/2004 Taper ..... 70/16
6,851,284 B1 2/2005 Kim et al.
2002/0108406 A1 8/2002 Makos et al.
2002/0189302 A1 12/2002 Anderson
2004/0016268 A1 1/2004 Makos et al.
2004/0216501 A1 11/2004 Clifton
2004/0237604 A1 * 12/2004 Kim et al. ..... 70/16
2005/0005656 A1 * 1/2005 Seebock ..... 70/16

* cited by examiner

FIG. 3
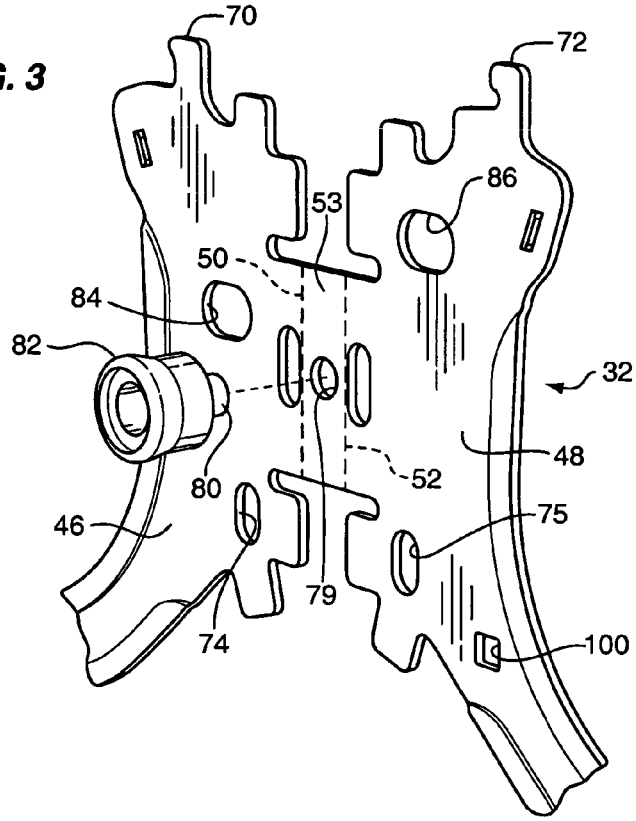
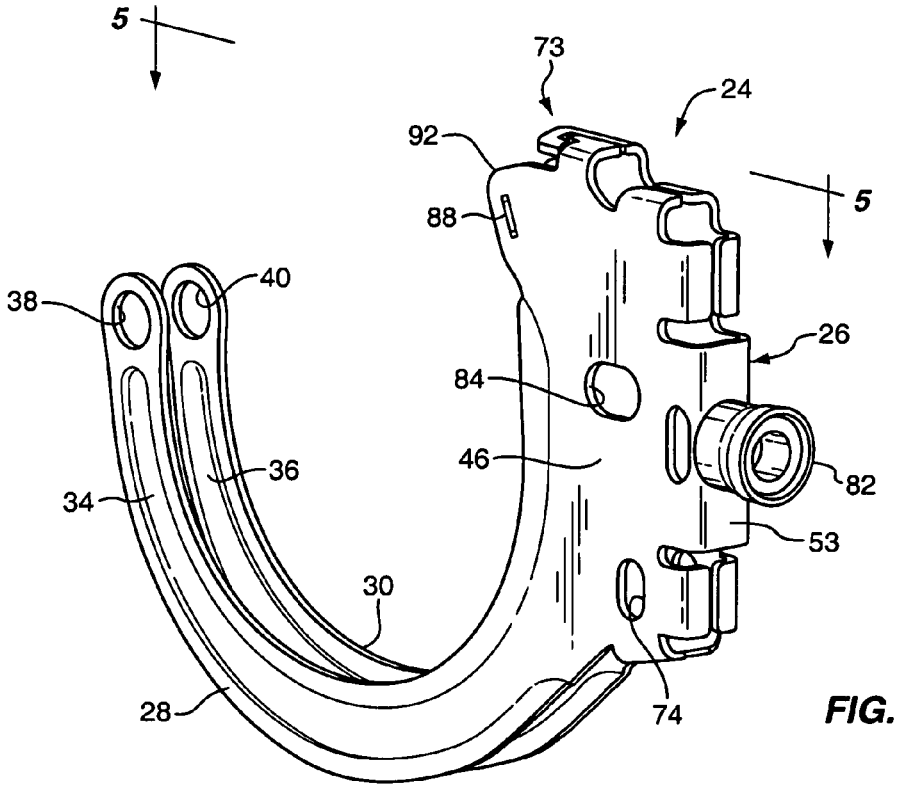
FIG. 4

FIG. 24
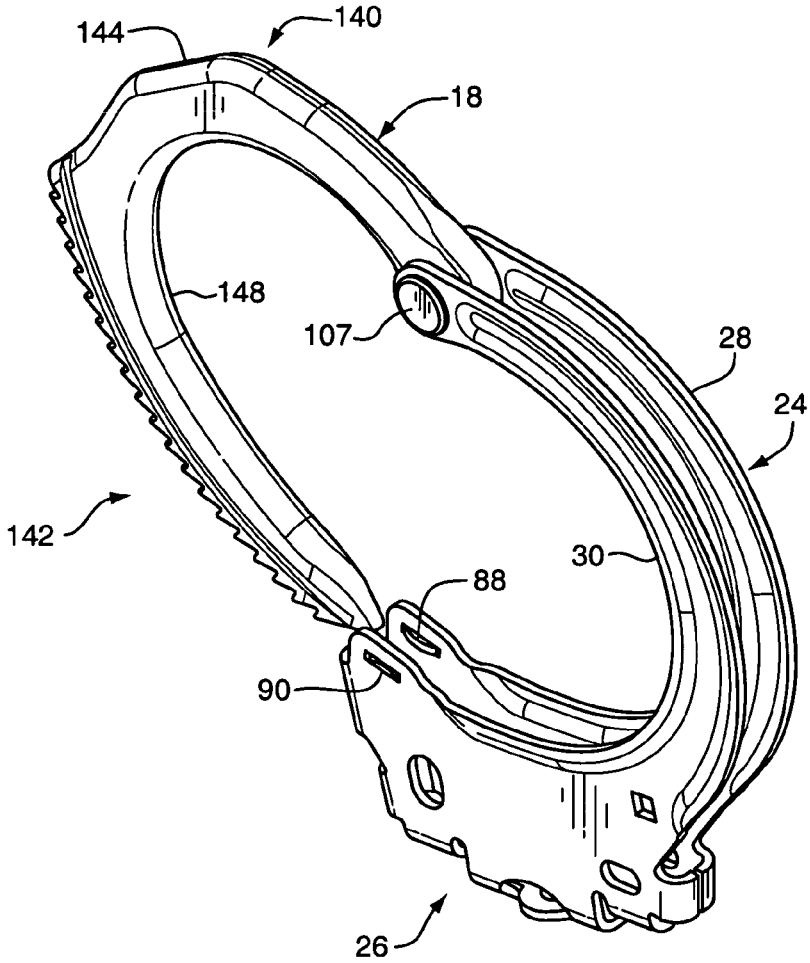
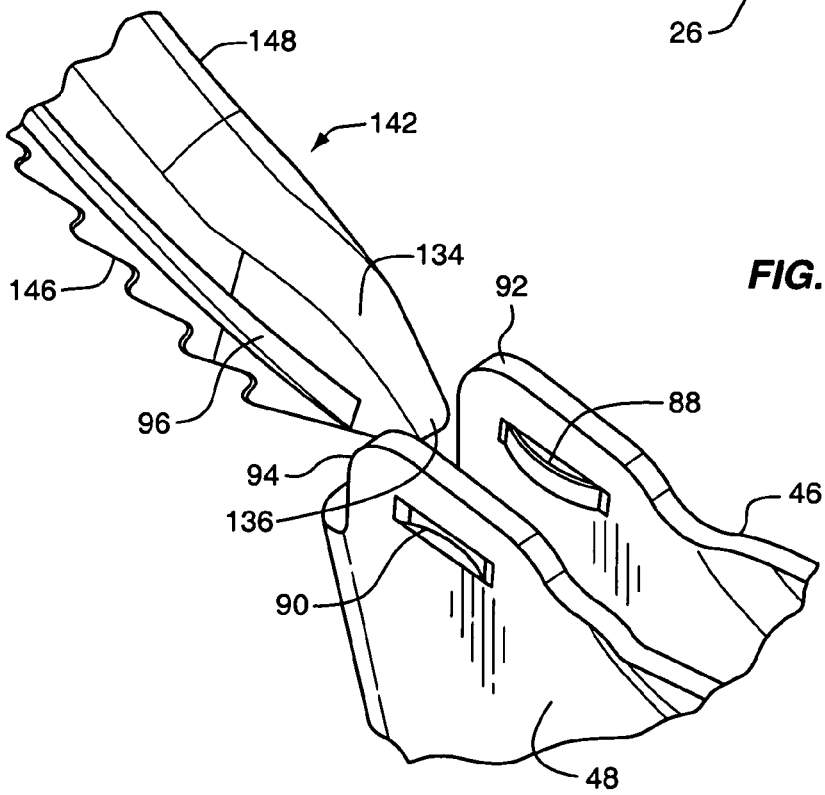
FIG. 25

TWO-SIDED KEY RELEASE FOR HANDCUFF

BACKGROUND OF THE INVENTION

1. Field of the Invention

The present invention relates to an improved set of handcuffs having a number of features, which facilitate their use. These features include, for example, a slightly larger bow for engaging a wrist of a person to be restrained where the envelope of the bow is defined by a conic path with an increasing arc, a rounded inner surface of the bow and cooperating arcuate cheek arms, cheek arms formed from a metal plate and having reinforcing ribs, a molded polymer covering surrounding the cheek arms and providing a round on the inner edge of the cheek arms which engage a wrist, interlocking tabs on the folded cheek arm forming plates, the folded cheek-arm forming plates which are covered by the polymer molding providing a non-riveted base frame and cheek arms, a flat on an outer surface of the bow for lining up a point of contact with a wrist, a removable lockset assembly for locking a pawl relative to ratchet teeth on the bow and including a slideable lock bar, key receiving structure on each side of the lockset assembly for receiving a key and enabling the key to be turned in one direction only for first unlocking a double lock, which prevents movement of the bow in either direction and for secondly, completely unlocking the handcuff by moving the pawl away from the bow and against a spring mechanism, a deflectable detent on a lockset housing for releasably locking the lockset assembly within the base frame of the molded cheek plate assembly, a swivel cup fixed in the base portion of the cheek plate assembly prior to polymer overmolding, and a swivel connected to a welded chain link and having a swivel a pin which is received in the swivel cup.

2. Description of the Related Art

Heretofore, a large number of handcuffs have been proposed. Several prior art U.S. patents disclosing previously proposed handcuffs and features thereof are set forth in the analogous and non-analogous U.S. patents listed below:

| U.S. PAT. NO. | PATENTEE |
|---|---|
| 4,314,466 | Harris |
| 4,574,600 | Moffett |
| 5,660,064 | Ecker et al. |
| 6,574,998 | Kwon |
| 6,672,116 | Hilliard |

Prior art handcuffs are typically known to be heavy and include a cheek plate assembly made of metal plates which are cut to a desired shape and riveted together such that rivet heads protrude from the sides of the cheek assembly.

In view of the rivet heads protruding form the cheek plate assembly, it is hard to align the cuffs and to fold the cuffs flat.

Also, in many designs of prior art handcuffs, a swivel base for connecting one handcuff to another handcuff protrudes from the cheek plate assembly. Additionally the connector or swivel connected to chain links are fixed in a cheek plate assembly prior to riveting such that if one handcuff is defective after riveting, the whole set, i.e., both handcuffs, have to be discarded.

Further, in prior art handcuffs the lock mechanism is subject to damage such as the breaking off of key posts or pins, chipped teeth, fatigued springs, sticking of double-lock bars, rusting and clogging with debris which require complete replacement of the handcuffs.

Prior art handcuffs typically only have one keyway in the cheek plate assembly such that a user of the handcuffs has to be trained to always have the keyway up for inserting the key.

Also, the handcuff key is rotatable in both rotational directions for two different (locking or unlocking) operations leading to confusion as to which way to turn the key for a desired operation.

Often it is difficult to unlock the handcuffs on the street. Further, difficulty is often incurred in removing the cuffs, particularly, from large subjects.

In currently used handcuffs, the swivel connection to chain links is typically the weakest part of the handcuff when subjected to lateral pressure. Further, the swivel shaft of a two-part swivel often stretches, distorts, and even breaks.

Often times, the cheek plates and/or the bow of the handcuff have edges along the inside of the curved surface of the bow or cheek plates which can cause trauma or injury to a wrist.

Also, the curved envelope of the bow and the curved envelope of the cheek plates in conventional handcuffs often do not properly fit many wrists and sometimes are not large enough or small enough.

As will be described in greater detail hereinafter, the handcuffs of the present invention have high strength and are relatively light weight with an arcuate conic-generated envelope design for the bow and for the cheek plates which provide handcuffs for accommodating a large wrist while at the same time being able to secure small wrists of juveniles and women.

The bow is preferably made of sintered metal powder with rounded inner edges and an outer flat contact surface. It is preferably polymer infused to prevent corrosion and absorption of body fluids, e.g., sweat.

Strength of the bow and cheek plates is maximized by the selection of an optimal combination of materials and heat treatment of the materials as well as design of frame geometry and provision of reinforcing ribs. Also, the use of a die stamped metal plate facilitates forming of a base frame and cheek plate arms of a unitized cheek plate assembly.

Furthermore, the use of a polymer overmold over the cheek plate frame produces a pair of a handcuff with rounded edges, beveled lock slots and beveled keyways. Additionally the polymer can be color coded to indicate the source of the handcuffs.

Finally, punching of track guide forming detents facilitates the forming of bowed or arcuate track guides for being received in track grooves in a toothed track portion.

Also, a unitized, replaceable lockset assembly is provided having a number of features including: a keyway on each side of a lockset assembly housing, a lock slot on each side, a slidable lock bar in side the housing with a locksetting slot aligned with the lock slots, color coding of the lock bar to facilitate locating same for inserting an actuating pin in the locksetting slot to move the lock bar between a single lock position and a double lock position, double locking of the teeth on the bow engaging teeth on a pawl, structure on the pawl and structure on the lock bar enabling a hand cuff key to be rotated in one direction only when inserted in either keyway and rotation in the one direction to move the lockset mechanism from a double lock position, to a single lock position and then to a completely unlock position.

BRIEF SUMMARY OF THE INVENTION

According to one of the teachings of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the bow having rounded inner edges and the bow being made of sintered metal powder.

According to another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the bow having inner rounded edges and having on its outer periphery, a flat contact face for engaging the side of a wrist upon application of the handcuff to a wrist.

According to still another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the bow having a first arcuate portion and a second curved portion including a tooth track portion and the first curved portion and second curved portion having an inside envelope defined by a conic path having an increasing arc so as to form an envelope for receiving various size wrists at different positions of the bow relative to the cheek plates with a minimum of pressure to the wrist.

Also according to another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the bow having a first arcuate portion and a second curved portion including a tooth track portion and the first curved portion and second curved portion having an inside envelope defined by a conic path having an increasing arc so as to form an envelope for receiving various size wrists at different positions of the bow relative to the cheek plates with a minimum of pressure to the wrist.

According to still another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the cheek plate assembly including a unitized metal frame formed from a die stamped metal plate which is folded into the unitized metal frame such that a cheek plate assembly with a flush profile and without projecting rivets is provided.

Further according to still another teaching of the present invention there is provided in a handcuff assembly comprising a bow pivotally connected to and between cheek plates of a cheek plate assembly that also includes a base frame containing a lock mechanism, the improvement residing in the base frame being folded from a die stamped metal plate which has an opening and a swivel pin having a mounting pin being received in the opening and swaged to fix the swivel cup to the metal plate prior to the formation of the base frame.

Additionally, according to another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the cheek plate assembly including a unitized metal frame formed from a die stamped metal plate which is folded into the cheek plates and the base frame, the base frame including a bottom plate and first and second side plates having interlocking hook formations defining a frame interlock which reinforces the base frame by the juxtaposition of the hook formations.

According to still another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the cheek plate assembly including a unitized metal frame formed from a die stamped metal plate which is folded into the unitized metal frame such that a cheek plate assembly with a flush profile and without projecting rivets is provided and the cheek plate assembly is overmolded with a polymer overmold. Preferably the polymer overmold that is color coded to provide an identification code such as for a security level or a particular law enforcement agency.

Still further according to another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the cheek plate assembly being made of two dissimilar materials.

Also, according to another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the lock mechanism comprising a replaceable lockset assembly mounted in the base frame.

According to still a further teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the lock mechanism comprising a lockset assembly mounted in the base frame and the base frame and the lockset having a keyway on either side thereof for receiving a key inserted from either side of the base frame.

Also according to another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the lock mechanism comprising a lock bar having a lock setting slot for receiving an actuating pin from either side of the lockset assembly, the pin being moved against one side of the slot for moving the locking bar from a single lock position to a double Further according to another teaching of the present invention there is provided in a handcuff assembly for use in a pair of handcuffs wherein each handcuff assembly comprises a bow pivotally connected to and between cheek plates of a cheek plate assembly that also includes a base frame containing a lock mechanism, the improvement residing in the lock mechanism comprising a lock bar having a lock setting slot for receiving an actuating pin from either side of the lockset assembly, and the lock bar being color coded so that the lock setting slot can easily be seen through openings in either side of the base frame.

Also according to another teaching of the present invention there is provided a unitized lockset assembly for use in a handcuff assembly and comprising a housing, a slidable lock bar in the housing, a lock bar pawl in the housing and having at least one tooth projecting from the housing, a spring in the housing between the lock bar and the lock bar pawl, and the lock bar and the lock bar pawl having mating structure for blocking movement of the pawl toward the lock bar and for allowing movement of the pawl toward the lock bar depending on the position of the lock bar.

Further according to another teaching of the present invention there is provided a unitized lockset assembly for use in a handcuff assembly and comprising a housing, a slidable lock bar in the housing, a lock bar pawl in the housing and having at least one tooth projecting from the housing, a spring in the housing between the lock bar and the lock bar pawl and the lock bar and the lock bar pawl having mating structure for blocking movement of the pawl toward the lock bar and for allowing movement of the pawl toward the lock bar depending on the position of the lock bar.

Still further according to another teaching of the present invention there is provided a unitized lockset assembly for use in a handcuff assembly and comprising a housing, a slidable lock bar in the housing, a lock bar pawl in the housing and having at least one tooth projecting from the housing, a spring in the housing between the lock bar and the lock bar pawl, the lock bar and the lock bar pawl having mating structure for blocking movement of the pawl toward the lock bar and for allowing movement of the pawl toward the lock bar depending on the position of the lock bar, at least one keyway in the housing, and structure on the pawl and structure on the lock bar which is engageable by a handcuff key inserted into the housing through the keyway and which permit the key to be rotated to move the lock bar from a double lock position to a single lock position.

Additionally, according to another teaching of the present invention there is provided a unitized lockset assembly for use in a handcuff assembly and comprising a housing, a slidable lock bar in the housing, a lock bar pawl in the housing and having at least one tooth projecting from the housing, a spring in the housing between the lock bar and the lock bar pawl, the lock bar and the lock bar pawl having mating structure for blocking movement of the pawl toward the lock bar and for allowing movement of the pawl toward the lock bar depending on the position of the lock bar, at least one keyway in the housing, and structure on the pawl and structure on the lock bar which is engageable by a handcuff key inserted into the housing through the keyway and which permit the key to be rotated in one direction only to move the lock bar from a double lock position to a single lock position and then to move the pawl to a complete unlock position where teeth on the pawl are moved out of engagement with teeth on a bow of a handcuff assembly

BRIEF DESCRIPTION OF THE SEVERAL VIEWS OF THE DRAWINGS

FIG. 3 is a perspective view of a base frame plate portion for the cheek plates before they are folded over to the position shown FIG. 4 and shows a swivel cup about to be positioned in the base frame plate portion.

FIG. 4 is a perspective view of the punched plate shown in FIG. 2 folded over and molded to form a unitized steel frame including the base frame portion and the cheek plates with the swivel cup mounted in the base frame portion.

FIG. 24 is a perspective view of the bow mounted to the cheek plates prior to encapsulation of the unitized steel frame and shows the tip of the bow and tooth track portion prior to engaging with the detents in the plates of the base frame portion;

FIG. 25 is an enlarged view of the portions broken away of the bow mounted to the cheek plates prior to encapsulation of the unitized steel frame and shows the tip of the bow and tooth track portion prior to engaging with the detents in the plates of the base frame portion.

DETAILED DESCRIPTION OF THE INVENTION

Figure 1:
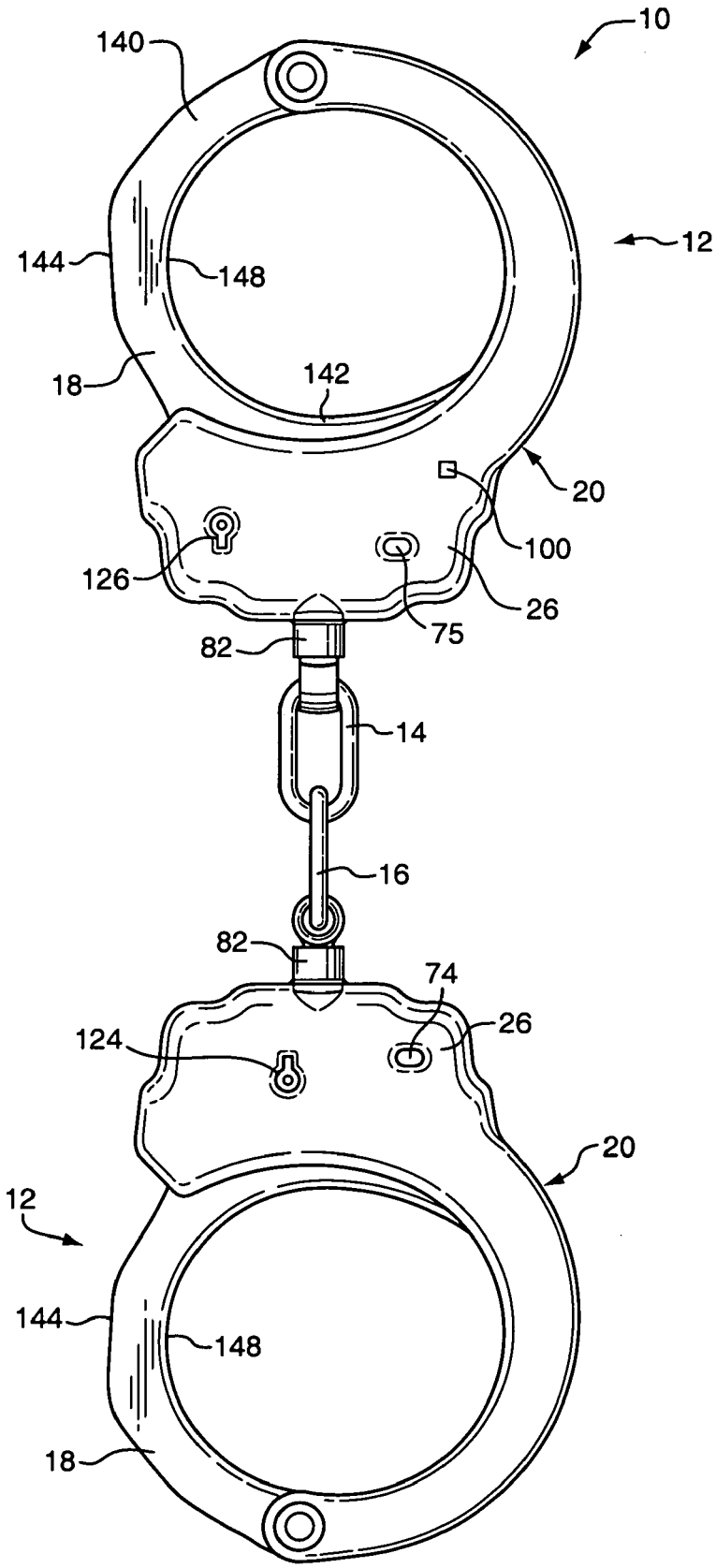
FIG. 1 is a plan view of a pair of handcuffs constructed according to the teachings of the present invention.

Referring now to the drawings in greater detail, there is illustrated in FIG. 1 a set of handcuffs 10 including two cuffs 12 linked together by two chain links 14 and 16. Each cuff 12 comprises a bow 18, pivotally connected to a molded cheek plate assembly 20.

Figure 2:
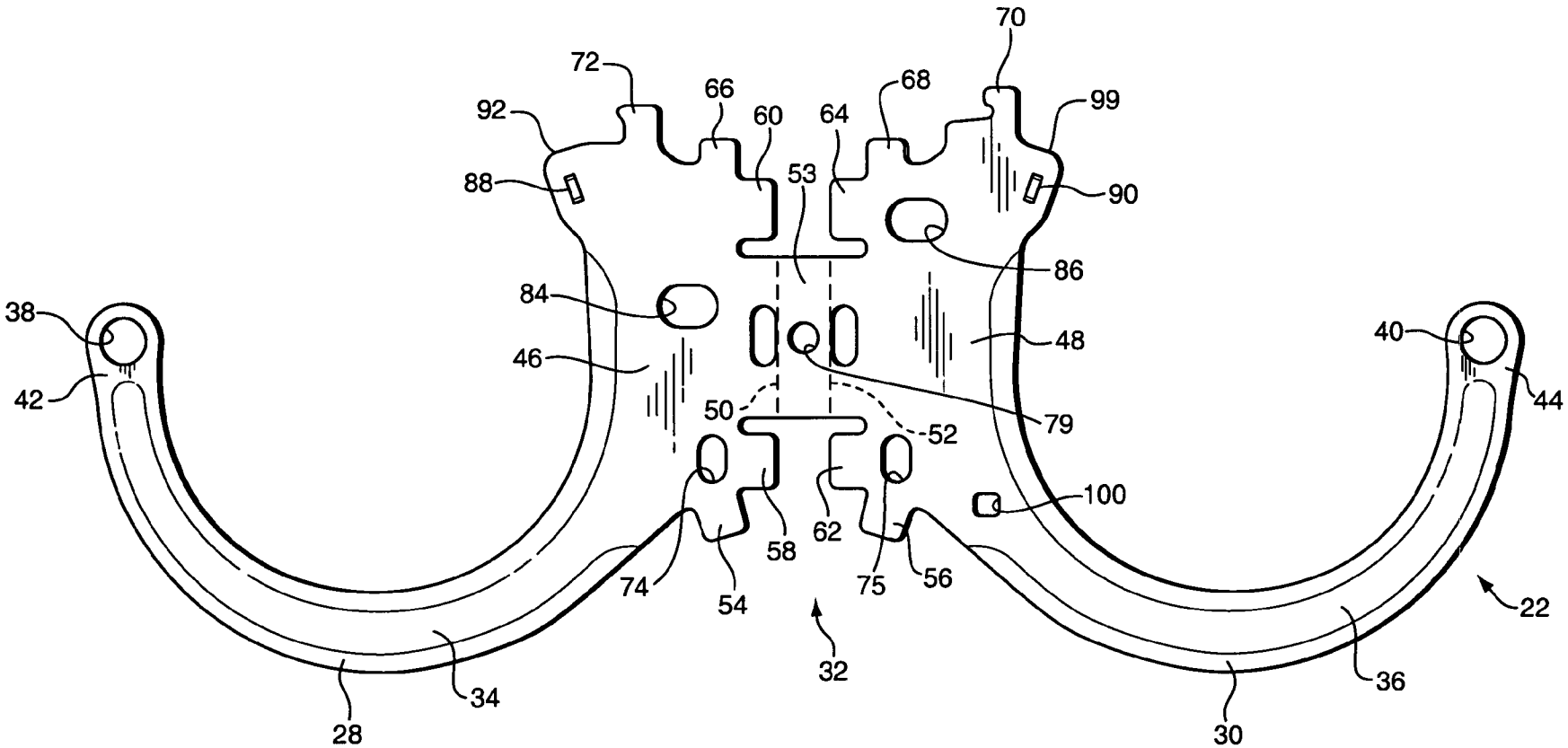
FIG. 2 is a plan view of a punched plate, which is folded over to create a pair of cheek plates.
Figure 5:
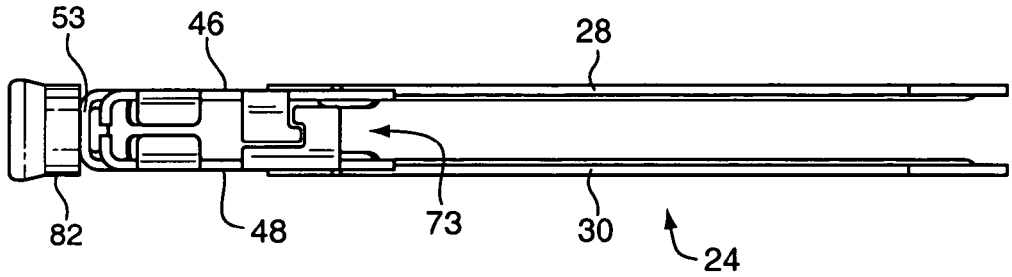
FIG. 5 is an end view of the unitized steel frame and shows the frame interlock in the base frame portion.

FIG. 2 illustrates a die stamped, stainless steel, metal plate 22 which is folded, bent or formed into a cheek plate frame assembly 24 including a base frame 26 and parallel spaced cheek arms 28 and 30 as shown in FIGS. 4 and 5.

In the figures, it will be understood that, for the sake of clarity and illustration, in some places the cheek plate frame assembly 24 is illustrated instead of the overmolded cheek plate assembly 20, which is the cheek plate frame assembly having a plastic overmold thereon.

The die stamped plate 22 includes a central base frame forming section 32 and first and second cheek arms or cheek arm plates 28 and 30 which form the cheek plate frame assembly 24 shown in FIGS. 4 and 5. A reinforcing rib 34 or 36 is stamped in each cheek arm plate 28, 30 and a hole 38 or 40 is punched in an outer end 42 or 44 of each cheek arm plate 28, 30 for facilitating pivotal mounting of the bow 18 to and between the cheek arms 28 and 30.

The central base forming section 32 of the die stamped metal plate 22 is specially configured as shown so that when side plates 46 and 48 are folded about phantom lines 50 and 52 to form bottom plate 53, end tabs 54 and 56 are folded inwardly, bottom tabs 58, 60, 62 and 64 are folded inwardly, front tabs 66 and 68 are folded inwardly and hook formations 70 and 72 are folded inwardly, as shown in FIGS. 4 and 5, the unitary base frame 26 is formed with a strong a frame interlock 73 formed by the interlocking hook formations 70 and 72.

The base frame forming portion 32 further includes two oval-shaped holes 74 and 75 punched therein which, when portions of the base frame forming portion 32 are folded will form aligned, opposed double-lock slots 74 and 75 for mating with a locksetting slot 76 in a double lock bar 77 in a lockset assembly 78 described in greater detail hereinafter in connection with the description of FIGS. 11 and 16–21.

Further, a center opening 79 is provided in the bottom plate 53 for receiving a mounting pin 80 of a swivel cup 82 (FIG. 3) in the bottom plate 53 of the base frame 26 prior to folding and bending of the plate 22 and prior to polymer overmolding.

Axially spaced a part keyway forming openings 84 and 86 are also formed in the die stamped metal plate 22, namely in the side plates 46 and 48 on either side of the bottom plate 53, such that a key can be inserted through either one of these keyway forming openings 84, 86 from either side of the base frame 26.

Also, two detents or track guides 88 and 90 are punched into the side plates 46 and 48 adjacent a corner 92 or 94 of the side plate 46 or 48 for being received in a track groove 96 or 98 (FIG. 23) in the bow 18.

Finally, a latch hole or notch 100 is provided in one of the side plates 46, 48, in the illustrated embodiment in side plate 48, for receiving a flexible detent 102 in/on a cover 103 for a housing shell 104 for a housing 105 of the lockset assembly 78 (FIG. 11) for latching the lockset assembly 78 in the base frame 26 while permitting removal of the lockset assembly 78 from the base frame 26.

FIG. 3 is a perspective view of the base plate forming portion 32 and shows the swivel cup 82 positioned to be mounted to the bottom plate 53.

The cheek plate frame assembly 24, before polymer overmolding of the frame assembly 24 with a plastic polymer overmold 106 (FIG. 9), is shown in FIGS. 4 and 5.

Figure 6:
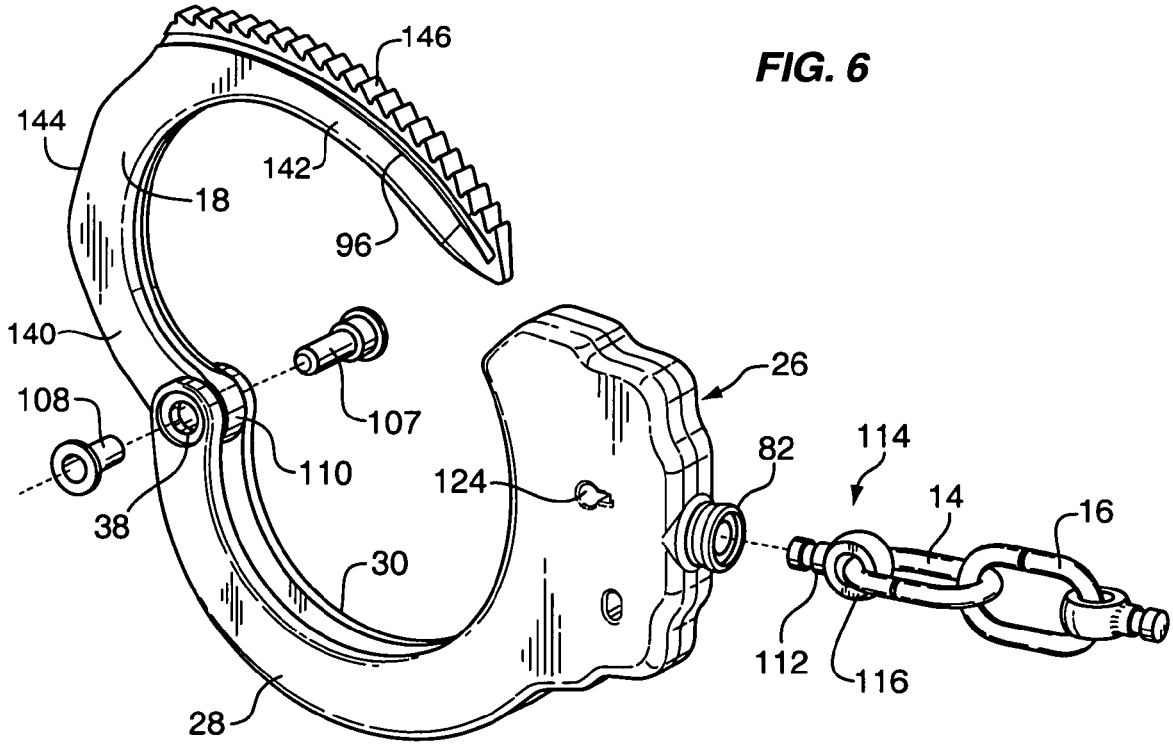
FIG. 6 is a perspective exploded view of one handcuff showing an open position of the bow relative to the encapsulated unitized steel frame and shows a exploded view of a rivet for connecting the bow to the pair of cheek plates and shows two (2) links mounted respectively to swivels each having a pin that is received in the swivel cup.
Figure 7:
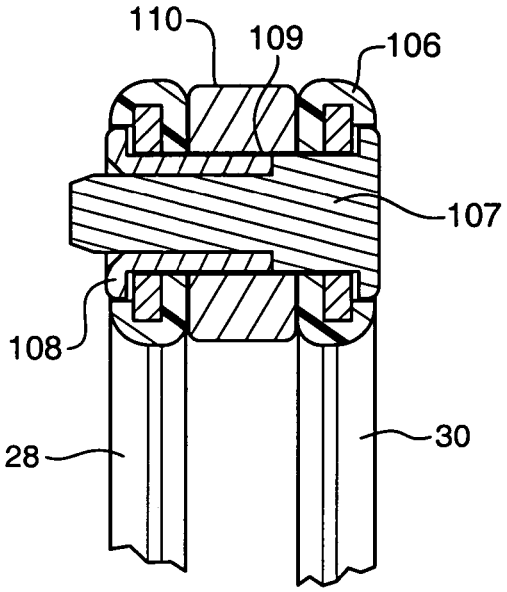
FIG. 7 is a sectional view through the assembled rivet between the bow and cheek plates prior to swaging.
Figure 8:
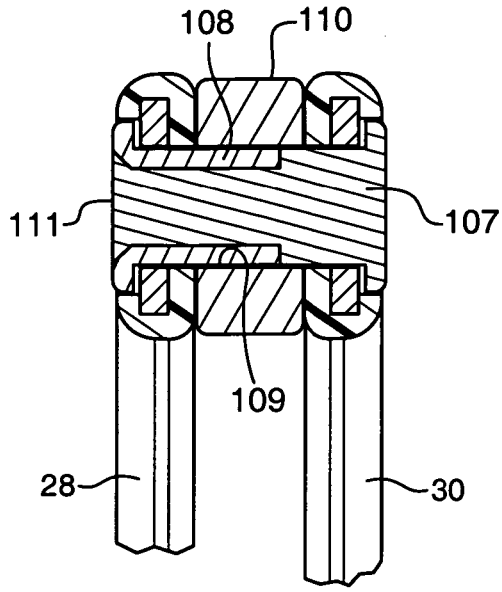
FIG. 8 is a is a sectional view of the completed rivet after swaging.

In FIG. 6 is illustrated a perspective view of an open cuff 12 showing a stainless steel pivot pin 107 and a stainless steel pivot bushing 108 positioned for insertion through holes 38 and 40 in the cheek arms 28 and 30 and a hole 109 (FIG. 7) in a base end 110 (FIG. 7) of the bow 18. The pin 107 is swaged, staked or riveted in place as show at 111 in FIG. 8.

Also shown is a swivel pin 112 of a swivel 114 mounted by a swivel eyelet 116 on the chain link 14 positioned for insertion into the swivel cup 82.

Figure 9:
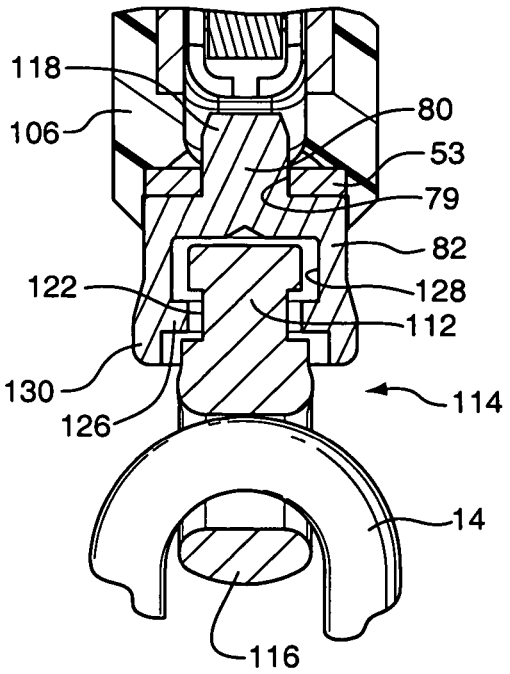
FIG. 9 is a sectional view through the swivel cup and pin of the swivel prior to swaging.
Figure 10:
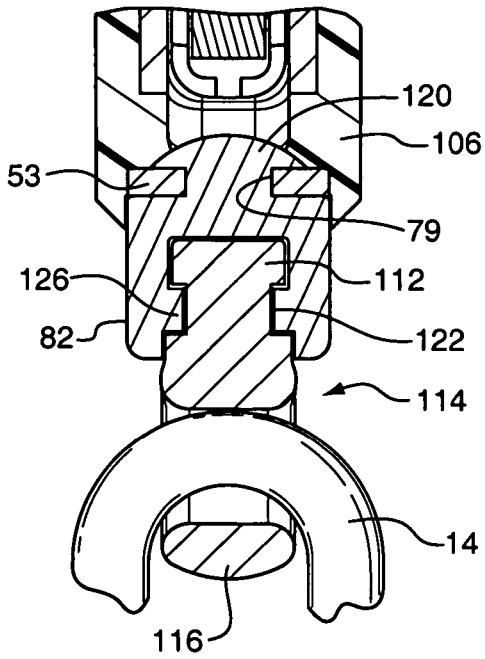
FIG. 10 is a sectional view of through the swivel cup after it is swaged to the base frame portion and after it is swaged to the pin of the swivel.

With reference to FIGS. 9 and 10, typically the swivel cup 82 is mounted to the die stamped metal plate 22 before it is folded and bent to form the base frame 26 and the cheek plate frame assembly 24 shown in FIGS. 4 and 5 and before polymer overmolding of the frame assembly 24. In this way, if the overmold is defective, only the defective overmolded frame assembly 24 and one swivel cup 82 needs to be discarded and not a whole set of handcuffs 10. Subsequently, an outer end 118 (FIG. 9) of the mounting pin 80 of the swivel cup 82 is swaged as shown at 120 in FIG. 10. Preferably, the mounting pin 80 is swaged prior to the folding and bending of the portions of the stamped die plate 22 and before the plastic overmold 106 is placed on the cheek plate frame assembly 24.

In one preferred embodiment, the mounting pin 80 is swaged before the overmolding of the frame assembly 24 with the plastic overmold 106 (FIGS. 9 and 10), although the mounting pin 80 is shown (incorrectly) unswaged in FIG. 9.

Typically, the swivel cup 82 is gripped outside a mold and liquid plastic is placed in the mold and around the frame assembly 24. The closing of the center opening 79 in the bottom plate 53 with the swaged mounting pin 82 serves to limit flow of the liquid plastic during overmolding and liquid plastic flow is blocked by the swivel cup 82. The plastic can be colored to indicate a level of the security officer having the handcuffs 10 or for indicating the source of the cuffs 10 or branch of service or agency, e.g., army, navy, FBI, city police, state police or sheriff's police using the cuffs 10.

The eyelet portion 116 of the swivel 114 is first received on the chain link 14 or 16 and then the swivel pin 112 is received in the swivel cup 82 as shown in FIG. 9. Here it will be seen that the swivel pin 112 includes a reduced in diameter neck portion 122 between the eyelet 116 and an end portion 124 of the swivel pin 112. It will also be seen that the swivel cup 82 has an annular rib 126 on an inner wall 128 of the swivel cup 82 which is aligned with the reduced in diameter neck portion 122 of the swivel pin 112 as shown in FIG. 9.

Then, the swivel cup 82, which is initially larger at the outer end 130 as shown in FIG. 9 is swaged to fix the annular rib 126 adjacent the reduced in diameter neck portion 122 of the swivel pin 82. The elasticity of the metal of the swivel cup 82 is such that although the annular rib 126 bottoms on the reduced in diameter neck portion 122 during the swaging operation, the annular rib 126 will spring back a small amount from its bottomed out position against the reduced in diameter neck portion 122. As a result, a low friction bearing type relationship is established between the swivel pin 112 and the swaged swivel cup 82 thereby to enable the swivel pin 112 to swivel easily with respect to the swivel cup 82, much like a shaft in a bearing.

The cheek arms 28 and 30 are positioned to be parallel spaced from each other as shown. Then, the side plates 46 and 48 and bottom plate 53, as well as the cheek arms 28 and 30 are covered with the plastic overmold 106 to provide the cheek plate assembly 20 with rounded edges and corners. Also the double lock slots 74 and 75 are beveled as a result of the plastic overmold as are keyways 124 and 126 formed in openings 84 and 86 in side plates 46 and 48.

It should be noted, that the plastic overmold 106 enables the cheek plate assembly 20 to have curved, rounded, or beveled edges which will minimize injury to a wrist from the cheek plate assembly 20. Further, the plastic overmolding allows the double-lock slots 74, 75 and the keyway openings 84, 86 (124, 126) to be beveled on each side of the base frame 26.

The bow 18 is preferably formed from stainless steel powder which is sintered, i.e., first subjected to pressure in a mold and second, subjected to heat. Just prior to application of high pressure, some of the metal powder is removed so that rounded edges of 0.040–0,120 inch can be formed, preferably about 0.080 inch. In this way, the bow 18 is made with rounded inner edges 132 and 133 best shown in FIG. 23 for presenting minimal trauma to the wrist of a person being restrained. An inner or base end 110 is formed with the hole 109 and an outer end 134 is tapered and has a blunt point 136 as shown in FIG. 25.

Figure 12:
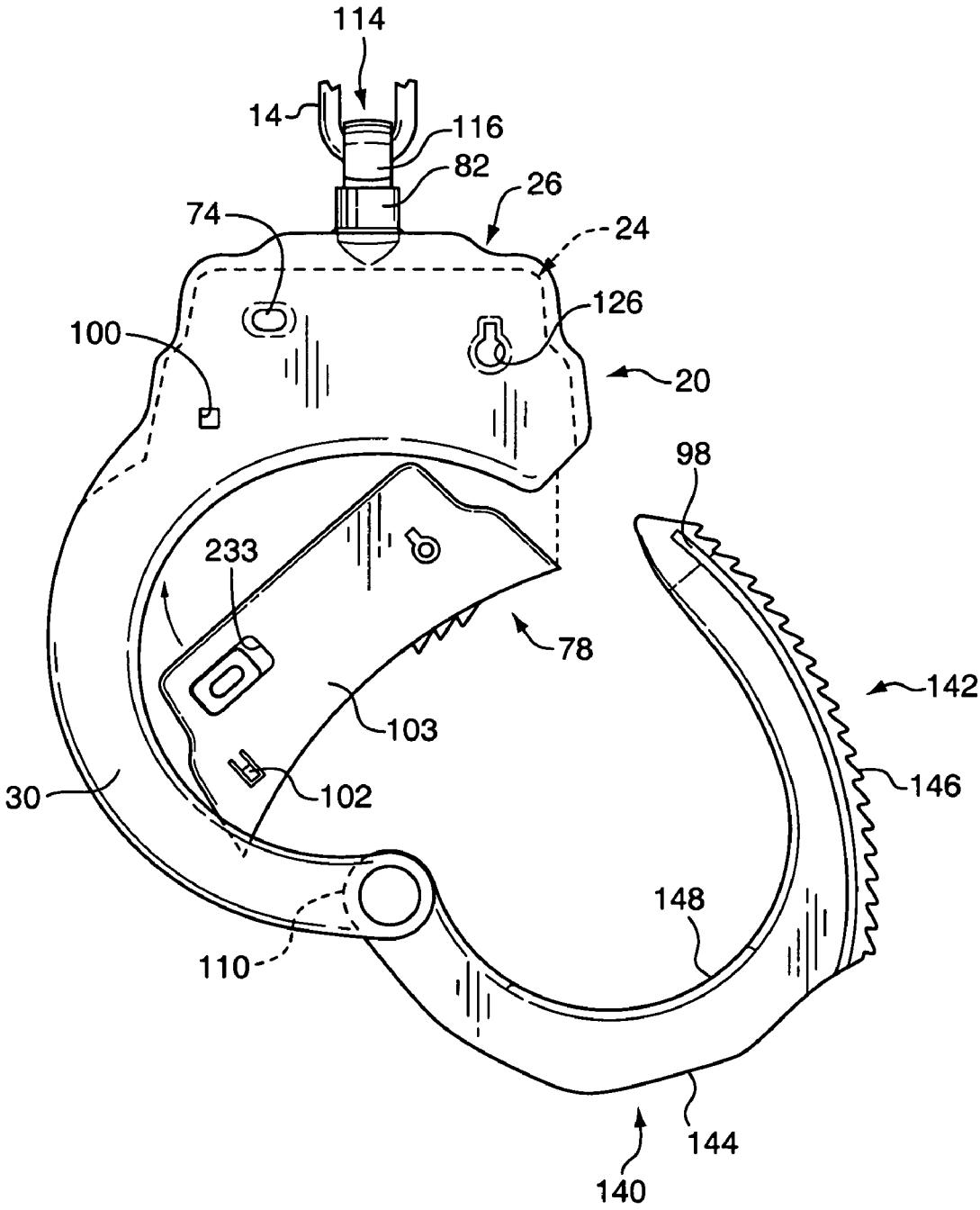
FIG. 12 is a plan view of one handcuff showing the bow in an open position relative to the encapsulated cheek plates and base frame portion and shows the double key lock insert assembly about to be inserted into the base frame portion.

Referring to FIG. 12, the bow 18 includes a first arcuate or curved portion 140 and a second arcuate or curved portion 142 defining a tooth track portion. The first arcuate portion 140 includes the base end 110 with hole 109 therein and has an outer, high contact, flat face 144 which is designed to be applied against the edge of a wrist for pushing the bow 18 through the cheek plate assembly 20 and come full circle about the pivot pin 107 and about a wrist. The second arcuate portion 142 defines a tooth track portion 142 and has spaced, wide, deep set, ratchet teeth 146 formed on an outer side thereof. The tooth track portion 142 is also formed with the arcuate track grooves 96 and 98 on either side thereof.

Further, the bow 18 is polymer infused to inhibit, if not altogether prevent rust or corrosion of the bow 18 and to inhibit, if not to altogether prevent, absorption of body fluids from the wrist of a person being restrained into the bow 18.

Additionally, and according to one of the teachings of the present invention, the envelope formed on an inner edge surface 148 of the bow starting from the base end 110 and extending to the pointed outer end 136 of the bow 18 is formed according to a conic path having an increasing arc so as to form an envelope adapted to receive various sized wrists at different positions of the bow 18 relative to the cheek plates or arms 28, 30 of the cheek plate assembly 20 and with a minimum of pressure applied to the wrist. Stated otherwise the conic path of the surface 148 is a curve generated by a projection of a portion of a conic onto a flat plane. The software for generating the design of this conic path is sold by Parametric Technologies Corporation of Needham, Mass. under their trademark, Pro/ENGINEER 3-D.

The conic path can be defined as follows:

Imagine taking a "string" and curling it around a cone starting from the top of a cone and going to the bottom of the cone. This establishes a conic path. Then the lower portion of that conic path is projected onto a plane and by trial and error, i.e. by adjusting the slope of the "string" and/or the angle at the apex of the cone, a conic path can be created empirically which closest approximates the human wrist for both a large wrist and for a small wrist. In this way, the envelope of the inner surface 148 formed when the bow 18 is engaged about a wrist and of the cheek arms 28, 30 extending about a wrist provide a close approximation to the envelope of the wrist and is slightly larger than the envelope of a prior art handcuff. It will be under stood that the envelope of the cheek arm plates 28 and 30 through the base frame 26 to the corners 92 and 94 of the unitized base frame 26 follows a similar conic path. The largest area created by the bow 18 and cheek plate assembly 20 when a first tooth 106 engages a tooth 209 in the lockset assembly 78 is about 5.67 square inches and the smallest area created when a last tooth 146 engages a tooth 209 in the lockset assembly 78 is about 2.8 square inches.

Again, it will be understood that the envelope of the inner edges of the cheek plate arms 28, 30 going from the outer ends 42 and 44 having the pivot pin mounting holes 38 and 40 to the entry point of the bowl 8 between the corners 92 and 94 of the base frame 26, also follows a similar or the same conic path having an increasing arc.

Figure 11:
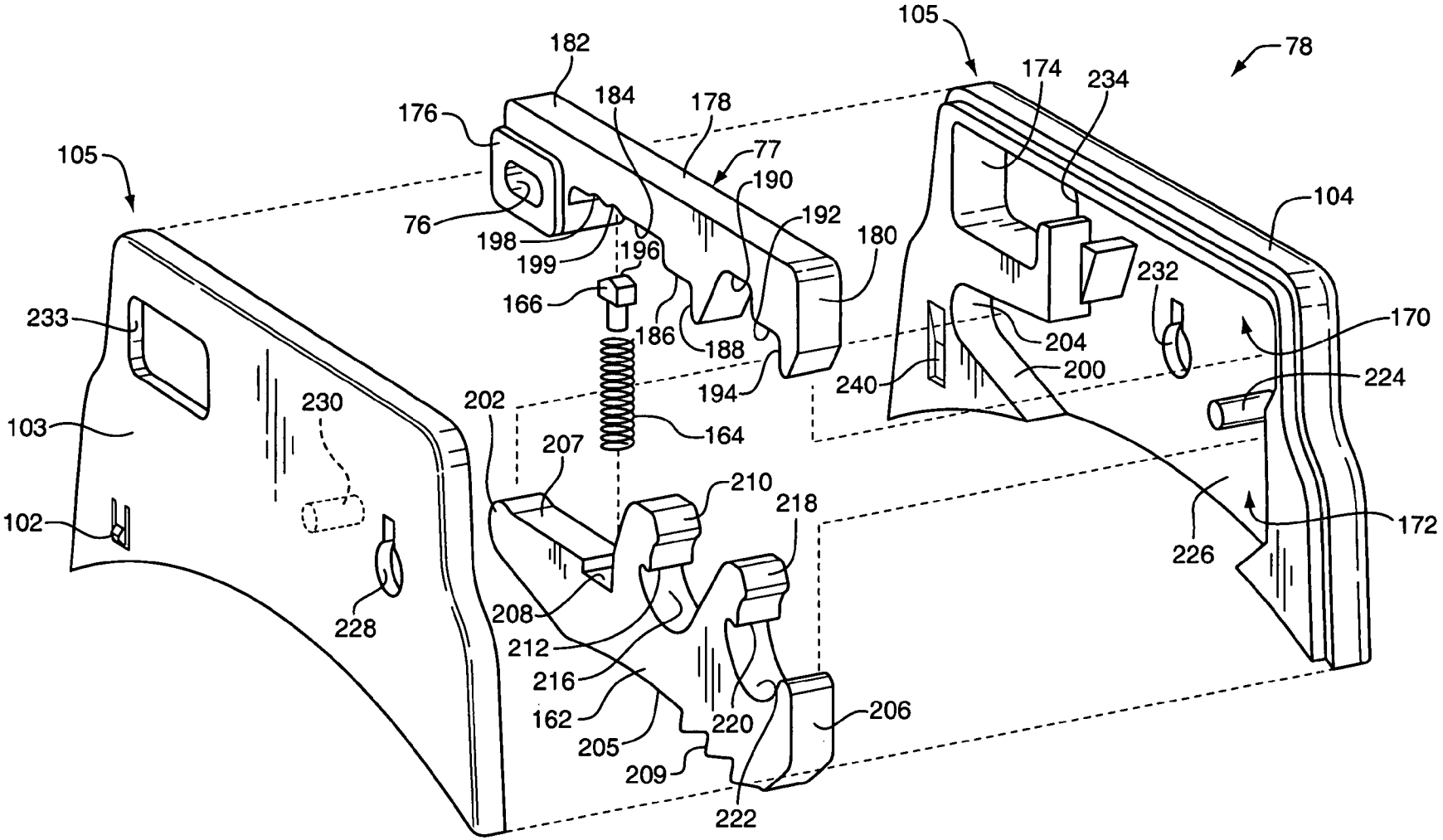
FIG. 11 is an exploded perspective view of the double key lock insert assembly.

Referring now to FIG. 11, there is illustrated therein the components of the replaceable lockset assembly 78 constructed according to one of the teachings of the present invention.

Figure 15:
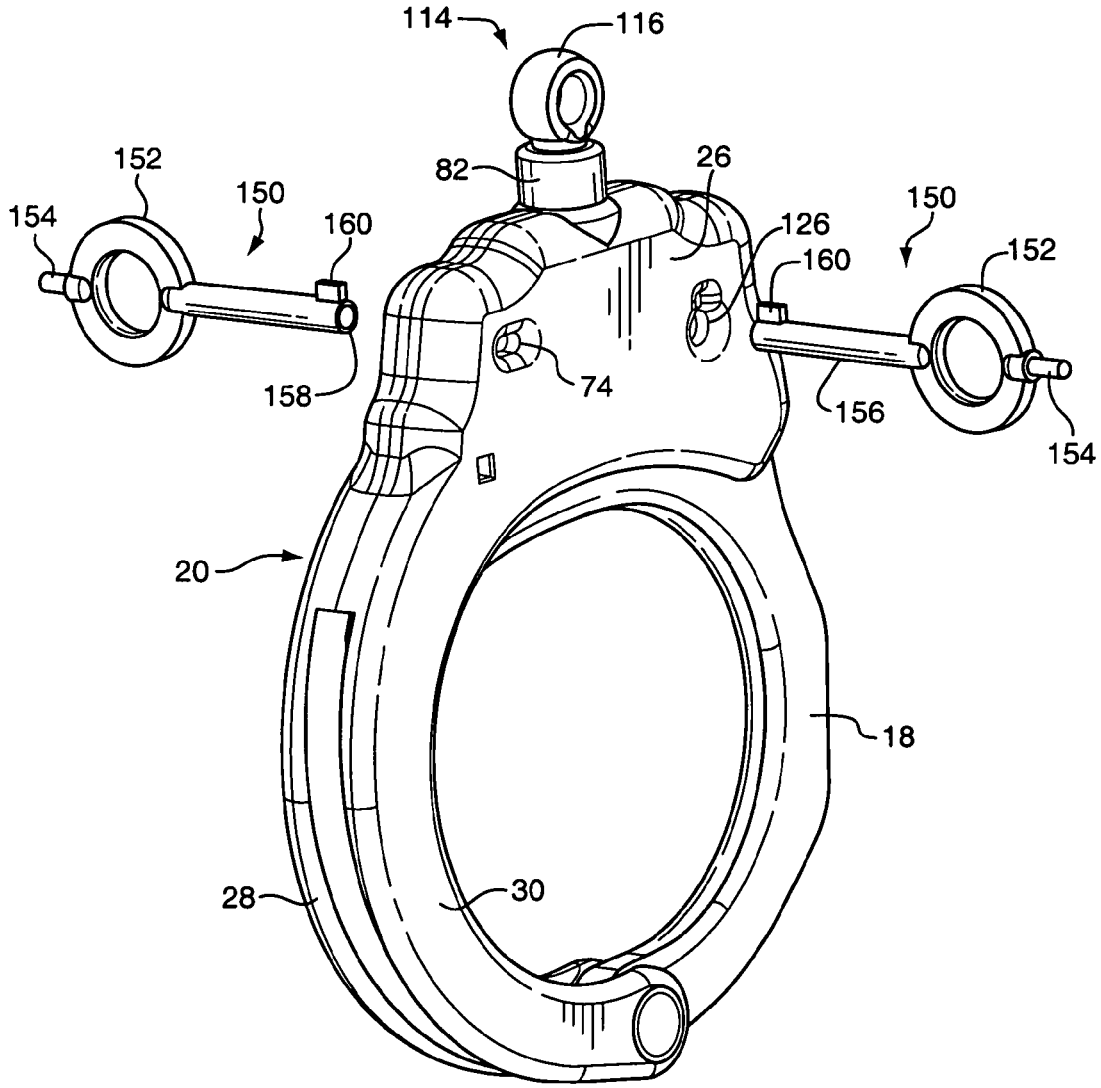
FIG. 15 is a perspective view of one handcuff in the closed position and shows two (2) keys positioned on either side of the base frame portion for insertion into the base frame portion for unlocking the handcuff.

The lockset assembly 78 shown in FIGS. 11 and 16–21 is constructed for use with conventional handcuff key 150 as shown in FIG. 15. Such a key 150 includes a ring-shaped handle 152 having a short actuating end pin 154 extending rearwardly therefrom and a shaft 156 extending forwardly therefrom to an outer, hollow cylindrical end 158. On the other surface of the outer cylindrical end 158 is a single, generally rectangularly shaped, tooth 160. This key 150 is generally standard for use in opening handcuffs and is adapted to be inserted into a keyway in a handcuff and rotated to lock and unlock the handcuff.

The rearwardly extending pin 154 is used to set the position of a double lock bar 77 in a lockset assembly, as will be explained in greater detail hereinafter.

Referring again to FIG. 11, the lockset assembly 78 includes the housing 105 which is shown exploded in two parts in FIG. 11) that includes the housing shell 104 and the housing cover 103. Inside the housing 105, there is positioned the double lock bar 77, a double lock bar pawl 162, a lock spring 164 and spring tip 166.

The housing shell 104 includes an upper cavity portion 170 and a lower cavity portion 172. The upper cavity portion 170 includes a rounded, generally rectangular shaped section 174 for receiving a generally rectangular-shaped block end 176 of the double lock bar 77. The rectangular-shaped block end 176 has the generally oval lock setting slot 76 extending therethrough for receiving the short actuating pin 154 on the key 150 from either side of the lockset assembly 78. The pin is moved laterally in the slot 76 to move the end 176 and thereby the double lock bar 77 between a single lock position and a double lock position described in greater detail hereinafter.

The double lock bar 77 further includes a bar portion 178 that extends from the generally rectangular shaped end 176 to an opposite end 180-of the double lock bar 77. An upper side surface 182 and a side surface (hidden from view) of the bar portion 178 are smooth for facilitating sliding movement adjacent wall surfaces of the housing shell 104. Preferably the double lock bar is made of plastic and colored, e.g., with the color red or white, so that the end 176 with slot 76 easily can be seen through the double lock slots 74 and 75 in the base frame 26.

Then, on the lower side of the double lock bar 77 and spaced a short distance from the generally rectangular end 176, there is provided a first space or cavity area 184, then a first step or land 186 followed by a first shoulder 188 going in a direction toward the end 180. Continuing toward the end 180 there is next provided a second space or cavity area 190, a second step or land 192 and a second shoulder 194 adjacent the end 180 of the double lock bar 77.

The lock spring tip 166 has an upper wedge shape tip 196 which is movable between two depressions or shallow V-shaped notches 198 and 199 located in the lower side of the double lock bar 77 between the rectangular block end 176 and the first space or cavity area 184, when the double lock bar 77 is moved between a single lock position (FIG. 17) and a double lock position (FIG. 18) to latch releasably the double lock bar 77 in either position. When the double lock bar 77 is moved between the two lock positions the spring 164 is compressed slightly as the wedge shape tip 196 snap-fittingly moves between the depressions or V-shaped notches 198 and 199.

The lower cavity portion 172 of the housing shell 104 has a rounded V-shaped cavity portion 200 into which a rounded end 202 of the double lock bar pawl 162 extends. This end 202 is rounded for pivoting on a rounded end wall 204 of the rounded V-shaped cavity portion 200. An opposite end 206 of the double lock bar pawl 162 is shaped to fit within the lower cavity portion 172 and is arranged for swinging movement within the lower cavity portion 172 about the opposite pivot end 202 of the double lock bar pawl 162.

Figure 18:
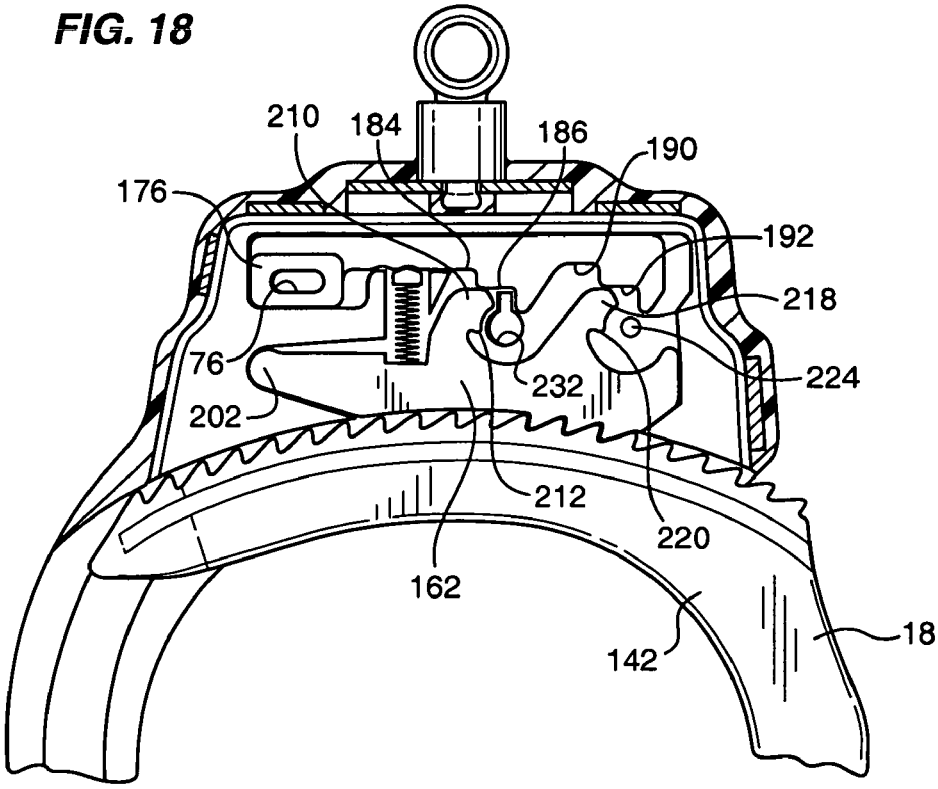
FIG. 18 is a plan view similar to FIG. 17 and shows the double lock bar moved to the double locked position where the tooth track portion of the bow cannot be retracted or ratcheted forward.
Figure 21:
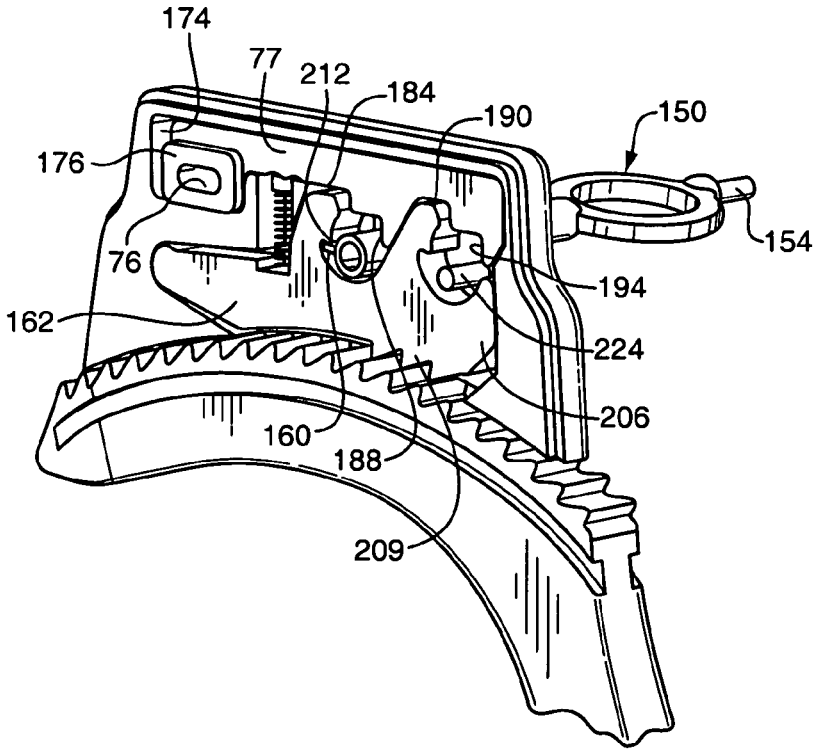
FIG. 21 is a view similar to the view shown in FIG. 20 and shows the tooth of the key rotated further counterclockwise to engage a shoulder on one (1) arm of the double lock bar pawl for moving the double lock bar pawl completely out of engagement with the tooth track portion of the bow.

An outer side 205 of the pawl 162 has a plurality of, typically three, teeth 209 which are constructed, sized and arranged to be received between and mesh with the teeth 146 on the outside of the tooth track portion 142 of the bow 18. On the other or inner side 207 of the double lock bar pawl 162 is a notch 208 for receiving the lock spring 164. The notch 208 is spaced from the rounded end 202. Then, extending from the inner side 207 of the pawl 162 and toward the lock bar 77 is a first leg 210 which, when the double lock bar 77 is positioned to the right as shown in FIG. 21, is positioned opposite the first space or cavity 184 in the double lock bar 77. When the double lock bar 77 is positioned to the left as shown in FIG. 18, the first leg 210 is positioned opposite to and adjacent the first step or land 184 on the double lock bar 77. The first leg has a block end and a curved side that extends to a first ledge 212 that faces back toward the bow 18. Then, a first actuate surface 216 extends from the first ledge 212 in an arcuate path to a second leg 218 which extends away from the inner side 207 of the pawl 162 and toward the double lock bar 77. This second leg 218 also has a block end and a curved side which extends to a second ledge 220. Extending from the second ledge 220 is a second arcuate surface 222 that extends in an arcuate path to the end 206. The first arcuate surface 216 and the second arcuate surface 222 are adapted to interact with the tooth 160 on the key 150 when the key 150 is inserted into the lockset assembly 76 as will be described in greater detail hereinafter.

As shown in FIG. 11, the housing shell 104 has a pin 224 extending from an inner wall surface 226 that extends along a first axis in line with a keyway 228 in the housing cover 103. Then, parallel spaced to this pin 224 is another pin 230 that extends from an inner wall surface of the housing cover 103 toward the housing shell 104 along a second axis which is aligned with a keyway 232 in the wall of the housing shell 104. The keyways 228 and 232 are arranged to be aligned with the keyways 126 and 124 in the overmold on the side plates 48 and 46 of the base frame 26.

It will be understood that the key 150 can be inserted through either keyway 232 or 228 with the hollow circular end 158 of the key 150 then being received over the pin 230 or the pin 224 and with the tooth 160 positioned adjacent the first arcuate surface 216 or second arcuate surface 222 of the double lock bar pawl 162.

A double look slot 233 is provided in the wall of the housing cover 103 in line with the generally rectangular rounded cavity 174 in the housing shell 104. The housing shell is provided with a similar double lock slot 234. Both double lock slots 233 and 234 are in line with the rectangular end 176 and with the double lock slots 74 and 75 in the side plates 46 and 48 of the base frame 26. The aligned slots 74, 233, 234 and 75 permit the actuating pin 154 on the key 150 to be inserted from either side of the base frame 26 into the lockset assembly 78 for engaging, one side of the locksetting slot 76 in the double lock bar 77 for moving the double lock bar 77 from a single lock position to a double lock position as will be described in greater detail hereinafter.

Figure 13:
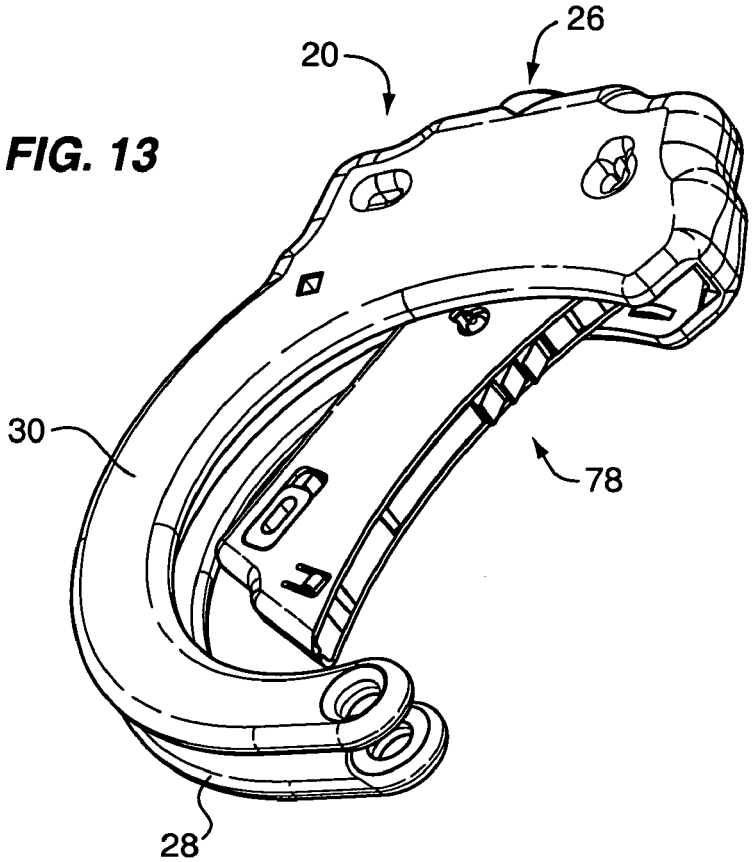
FIG. 13 is a perspective view of the encapsulated cheek plates and base frame portion with the double key lock insert assembly partially inserted into the base frame portion.
Figure 14:
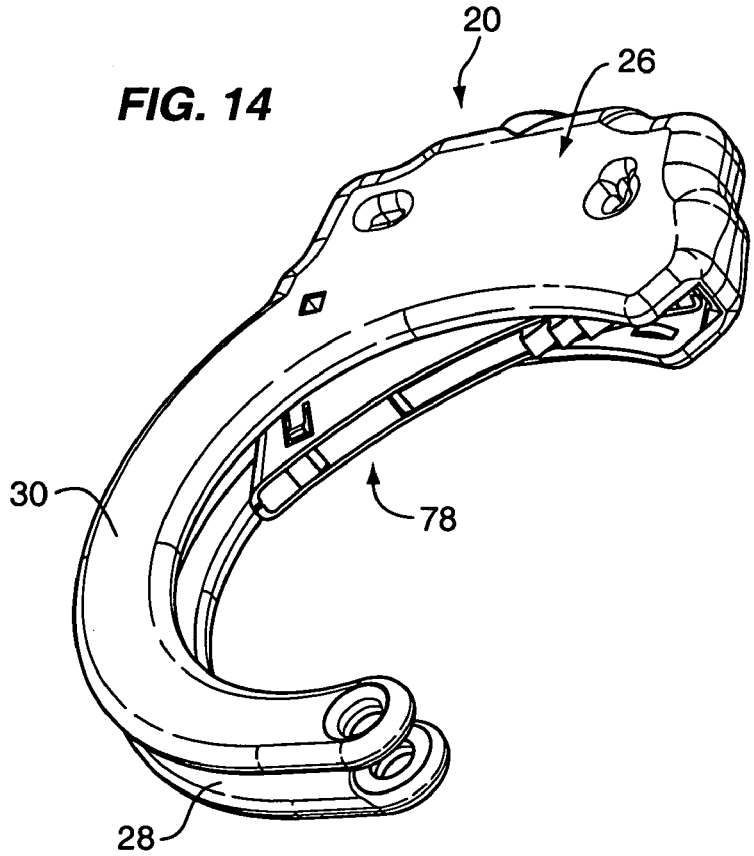
FIG. 14 is a perspective view similar to FIG. 13 and shows the double key lock insert assembly almost fully inserted into the base frame portion.

Referring now to FIG. 12, it will be seen that the assembled lockset assembly 78 is pivotally inserted into the hollow interior of the base frame 26 and rotated into and moved linearly into the hollow interior of the base frame 26 until the deflectable detent 102 is snap fittingly received into the latching notch 100 in the side plate 48 of the base frame 26. The progressive movement of the lockset assembly 78 into the base frame 26 is shown in FIGS. 13 and 14.

Figure 16:
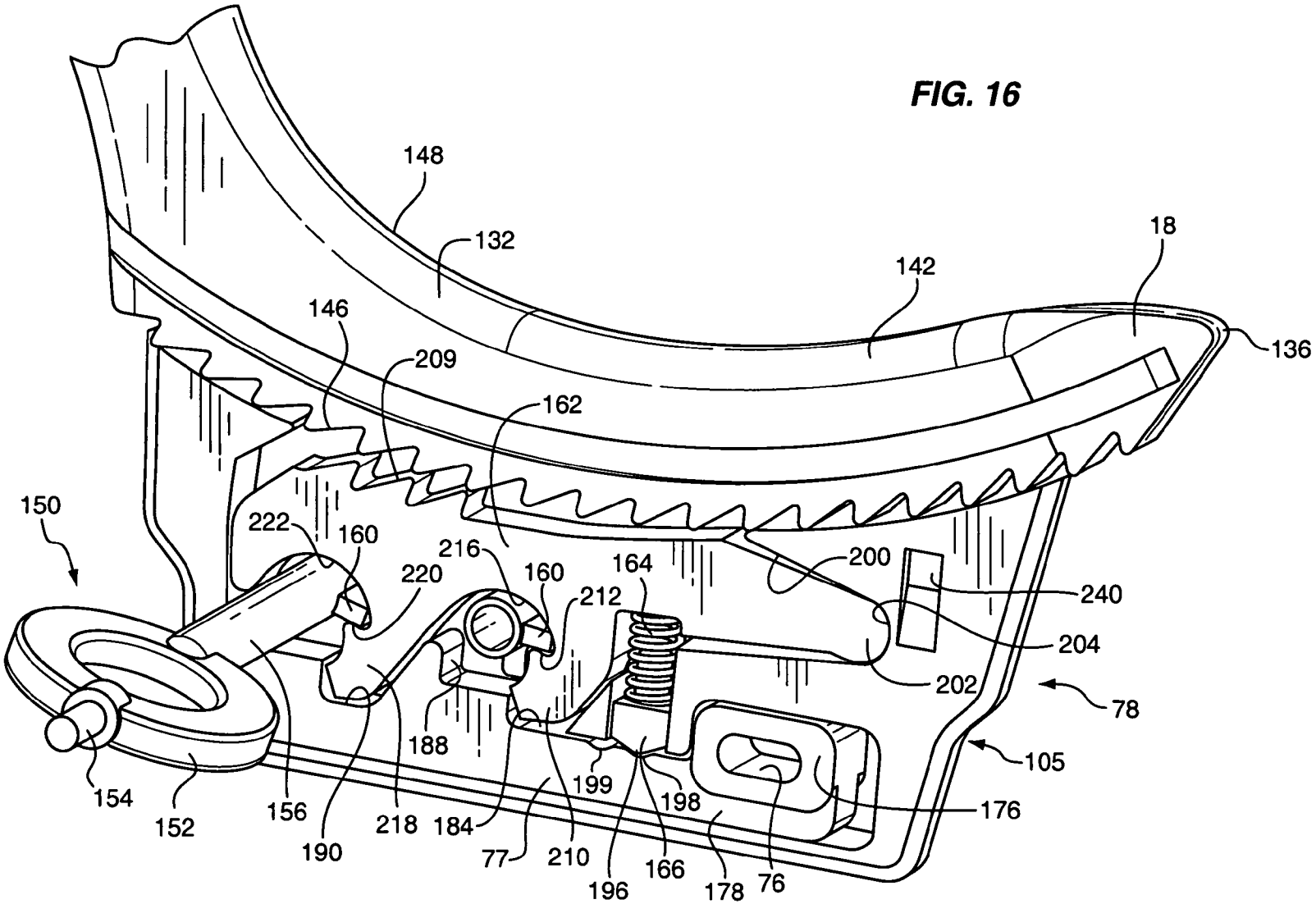
FIG. 16 is a perspective view of the tooth track portion of the bow interacting with a double lock bar pawl in the double key lock insert assembly and shows the end portions of two (2) keys inserted from either side of the handcuff positioned to interact with arms of the double lock bar pawl.

FIG. 16 is a perspective view of the inside of the lockset assembly 78 with the tooth track portion 142 of the bow 18 adjacent the lockset assembly 78. Here the double lock bar 77 is shown moved to the single lock position. Also, the tooth 160 of either key 150 is shown rotated against the first ledge 212 of the first leg 210 of the pawl 162 or against the second ledge 220 of the second leg 218 of the pawl 162. Note that with the double lock bar 77 in the single lock position, the block ends of the first and second legs 210 and 218 can move into the first and second spaces/cavities 186, 190, respectively by the engagement of the tooth 160 with the ledge 212 or 220 to move the pawl 162 completely out of engagement with the tooth track portion 142 of the tooth track portion of the bow 18. This is the fully unlocked position.

Figure 17:
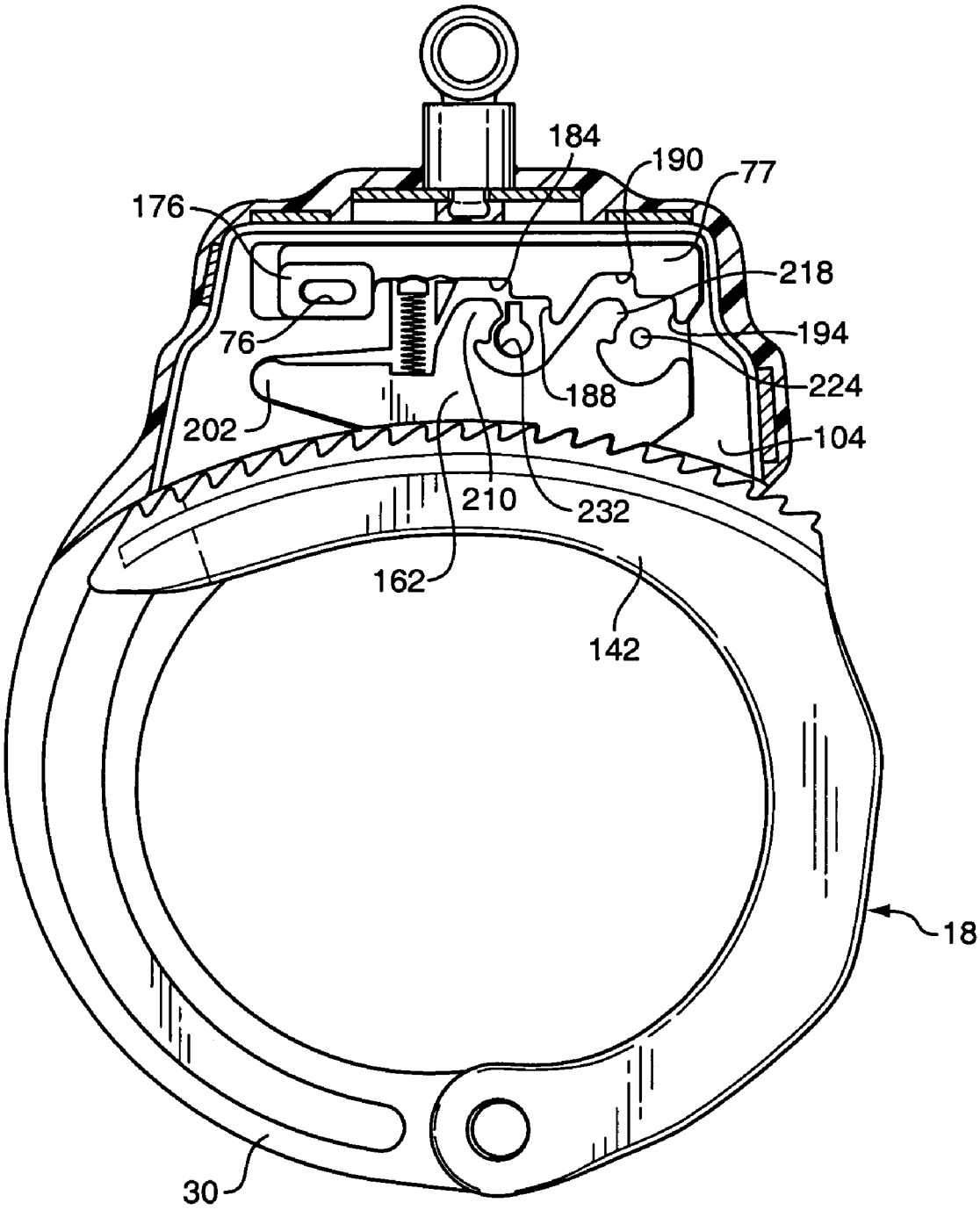
FIG. 17 is a plan view of tooth track portion of the bow engaged with the double lock bar pawl and shows a double lock bar in a single locked position where the tooth track portion can be moved or ratcheted forward.

FIG. 17 shows the double lock bar 77 in the single lock position similar to the position shown in FIG. 16, but without a key 150 rotated to a completely unlock position. Here the teeth 146 on the tooth track portion 142 of the bow 18 can ratchet forwardly (to the left) but nor rearwardly (to the right).

In FIG. 18 is shown a double lock position of the double lock bar 77 where the block end of the first leg 210 of the pawl 162 is adjacent the first land or step 186 which prevents movement of the pawl 162 away from the bow 18. This prevents forward movement of the tooth track portion 142 of the bow. Such forward movement of the tooth track portion 142 is also prevented by the juxtaposition of the block end of the second leg 218 adjacent the second land or step 190 on the double lock bar 77.

The double lock also can be unlocked with insertion of the key 150 into one of the keyways 232 or 228 in the housing 105. Note that when a key end 158 is inserted into the keyway 232 shown in FIG. 18 or 19, and over the pin 230, the tooth 160 can only be rotated against the first shoulder 188 to move the double lock bar 77 from the double lock position to the single lock position. An attempt to rotate the key 150 in the opposite rotational direction is blocked by the first leg 210 of the pawl 162 which cannot be moved to the left by reason of the rounded end 202 of the pawl 162 bearing against the rounded wall 204. The same result is obtained when a tooth 160 is positioned between the second shoulder 194 of the double lock bar 77 and the second leg 218 of the pawl 162. Thus an end 158 of a key 150 inserted through either keyway 232 or 228 can only be rotated in one rotational direction and this results in the tooth 160 first engaging the shoulder 188 or 194 on the double lock bar 77 to move it to the single lock position. Further rotation of the key end 158 results in a sweep of the tooth 160 adjacent the first or second arcuate surface 216 or 222 on the pawl 162 until the tooth 160 engages the first or second ledge 212 or 220 on the first or second leg 210 or 218 to move the legs 210 and 218 into the spaces 184 and 190 to completely disengage the teeth 209 on the pawl 162 from the teeth 146 on the tooth track portion 142 of the bow 18 as shown in FIGS. 16 and 21.

Whenever the lockset assembly 78 cease to function properly, It will be understood that the lockset assembly 78 can be disengaged from its position within the hollow interior of the base frame 26 by inserting a tool (such as an awl or screwdriver) into the base frame 26 from a position outside of and into and between the cheek arms 28 and 30 and at the same time depress the deflectable detent 102 out of the latching notch 100 and into a recess 240 for this purpose formed in the inner wall surface 226 of the housing shell 104 and pry the lockset assembly 78 out of the base frame 26 to replace the same. This will be done in steps starting with the position of the lockset assembly 78 inside the base frame 26 and then going to the position shown in FIG. 14 and then the position shown in FIG. 13 and then finally to the fully released position shown in FIG. 12.

FIG. 15 illustrates another important feature of the handcuffs 10 of the present invention, namely the ability to insert a key 150 from either side of the handcuff 12 into the base frame 26 for engagement with the double lock bar 77 and pawl 162 inside the lockset assembly 78.

Figure 19:
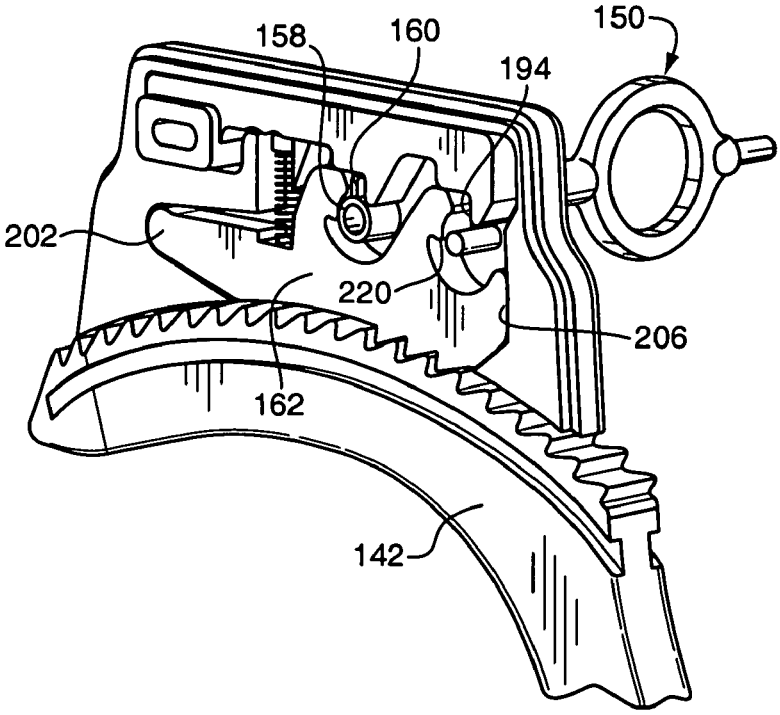
FIG. 19 is a fragmentary perspective view of the double lockset assembly showing the locking bar in the double locked position with a key inserted from the other side of the handcuff.
Figure 20:
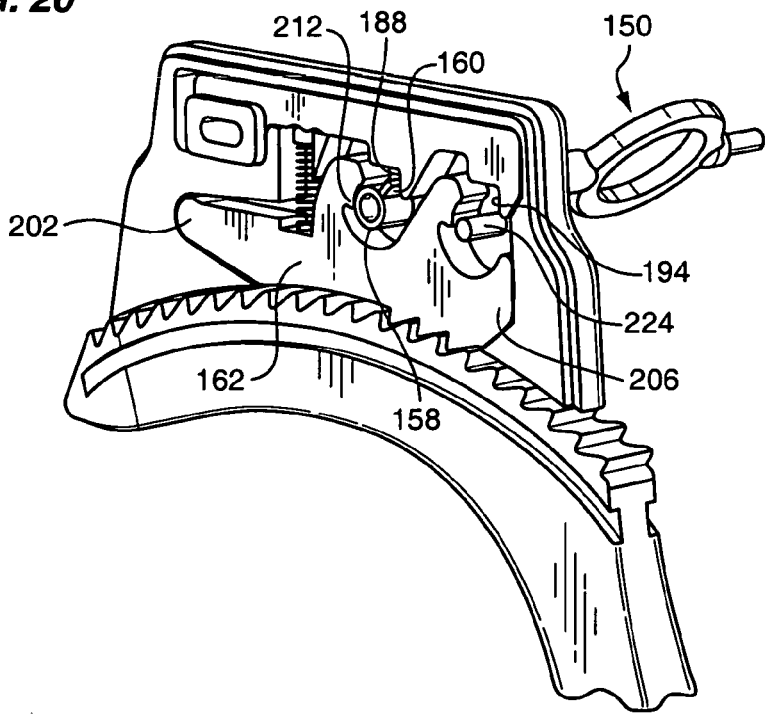
FIG. 20 is a view similar to the view shown in FIG. 19 and shows the key rotated counterclockwise to move the tooth against a shoulder of the double lock bar to move the double lock bar relative to the double lock bar pawl to a pawl ratchet position.

Starting with FIG. 19, which is a perspective view of the locking mechanism inside the lockset assembly 78 shown in FIG. 18, the key 150 is rotated as shown in FIG. 20. This results in the tooth 160 engaging the first shoulder 188 on the double lock bar 77. It will be understood that a key 150 inserted from the other side of the base frame 26 and rotated clockwise will result in the tooth 160 engaging the second shoulder 194 on the double lock bar 77.

Then, as shown in FIG. 21 (and also in FIG. 16), continued rotation of the key 150 will bring the tooth 160 into engagement with the first or second arcuate surfaces 216 or 222 until the tooth 160 engages the first ledge 212 on the first leg 210 or the second ledge 220 on the second leg 218 where the first leg 210 and the second leg 218 are urged toward the spaces 184 and 190 on the double lock bar 77 and at the same time urges the teeth 209 out of engagement with the teeth 146 on the tooth track portion 142 of the bow 18, as best shown in FIGS. 21 and 16.

Figure 22:
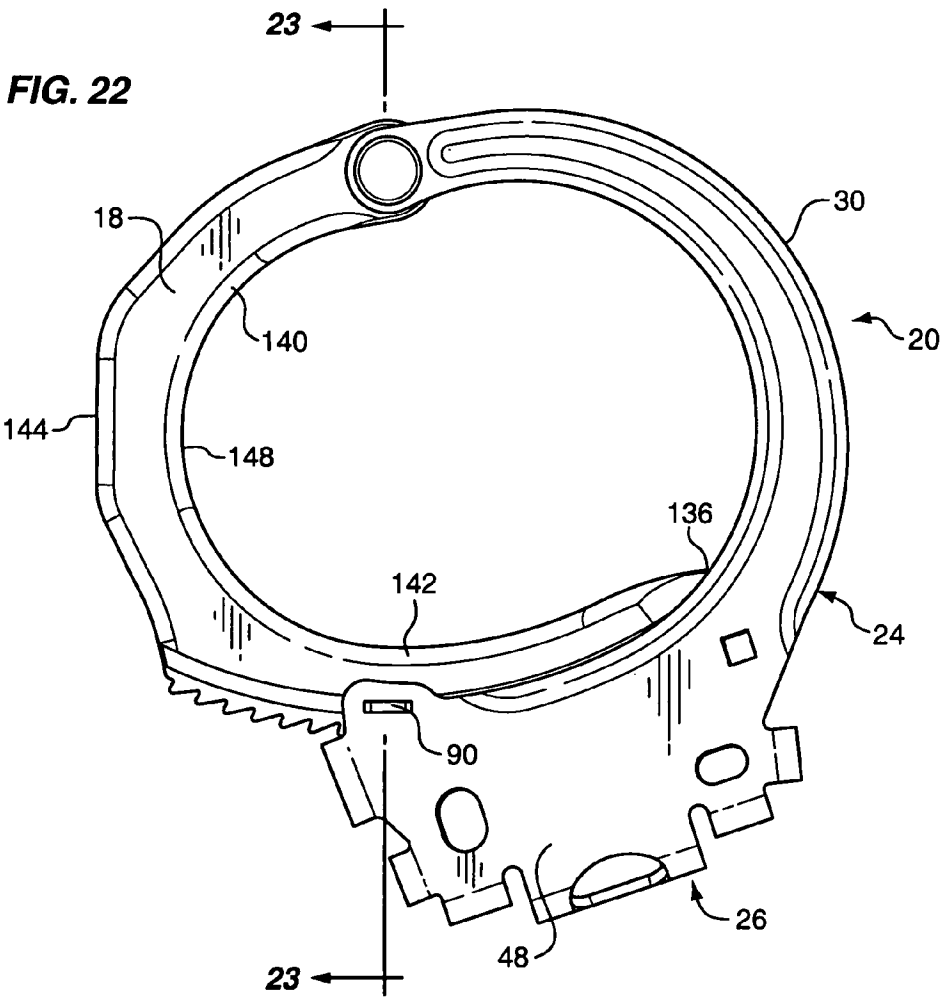
FIG. 22 is a plan view of the bow mounted to the cheek plates prior to encapsulation of the unitized steel frame and shows a detent formed in one (1) side of the base frame portion received in a track groove in the tooth track portion.

Referring now to FIGS. 22–25, and particularly to FIG. 22, it will be seen that the detents 88 and 90 are located on tangents to a curve of an arc that is generated on a radius between the center of the pivot pin 107 and the center of each detent 88 or 90. As a result, when the bow 18 is rotated counterclockwise in the view of same shown in FIG. 22, the tooth track portion 142 will move smoothly through the cheek plate assembly 20 with the track guides 88, 90 formed by the detents 88, 90 passing through the track groove 96 or 98 on either side of the bow 18.

As best shown in FIGS. 24 and 25, the track guides or detents 88, 90 have a rounded configuration for facilitating engagement with the track grooves 96, 98 and facilitate guiding of the bow 18 between the side plates 46 and 48 of the base frame 26 and thereby through and between the cheek plate arms 28 and 30.

Figure 23:
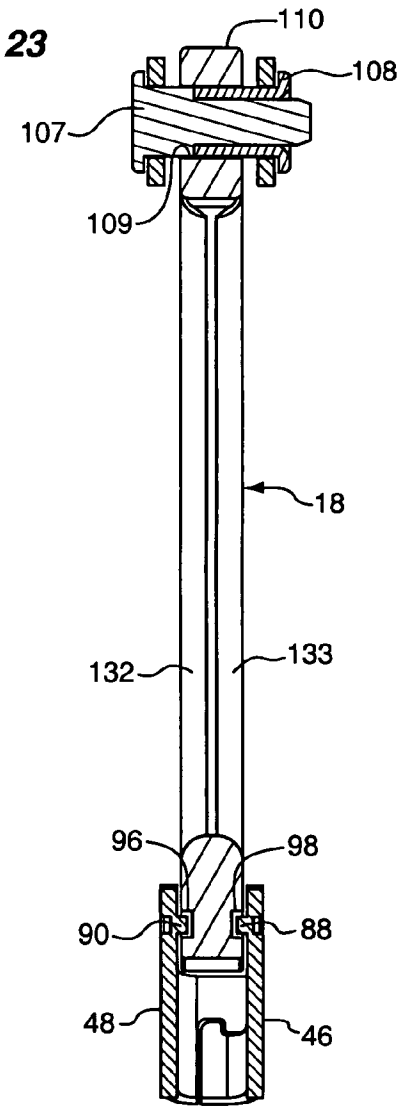
FIG. 23 is a sectional view through the handcuff shown in FIG. 22, taken along line 23—23 of FIG. 2 and shows detents in each plate of the base frame portion received in track grooves in each side of the tooth track portion of the bow.

In FIGS. 22–25, the unitized frame assembly is shown prior to encapsulation to better illustrate the relationship between the track grooves 96, 98 in the tooth track portion 142 of the bow 18 and the detents or track guides 88, 90. In FIG. 23 it will be seen that the track guide forming detents 88 and 90 are pushed out of the respective side plates 46 and 48 (into the space between the side plates 46 and 48) and form curved rails that have an outer curved surface which are received in the track grooves 96 and 98. Also the rails have a high lateral strength for holding the bow 18 when a test tension force is applied to the handcuff 12 which tends to pull the cheek plates 28, 30 away from the bow in the base frame 26.

From the foregoing description, it will be understood that the pair of handcuffs 10 of the present invention and the individual handcuffs 12 thereof have a number of advantageous features some of which have been described above and others of which are inherent in the invention. In particular, the set of handcuffs 10 include a bow 18 slightly larger than a prior art bow and arcuate cheek arms slightly larger than prior art cheek arms for engaging wrists of a person to be restrained.

Further, the edges of the actuate cheek arms and of the bow are rounded on the inner surface thereof to minimize trauma to a wrist. The cheek plate assembly is formed from a die stamped metal plate which is folded and bent and includes a frame inner lock as well as reinforcing ribs in the cheek arms which enhance the strength of the cheek plate assembly.

The method for making the cheek plate assembly 20 by first stamping the metal plate 22 with a center hole 79, inserting the mounting pin 80 of the swivel cup 82 in the center hole 79, swaging the mounting pin 80 over the metal plate 22, bending and folding the metal plate 22 to form the cheek plate frame assembly 24 including the base frame 26 and then overmolding with frame assembly 24 with a polymer overmold prior to mounting the swivel 114 in the swivel cup 82, saves on waste by only throwing out defective overmolded frame assemblies 24 and not a whole set of handcuffs 10.

The cheek plate assembly is overmolded with a plastic material to provide rounded edges and beveled edges for keyways and for double lock slots in the cheek plate assembly. The formation of a base frame for the cheek assembly from a die stamp metal plate results in a non-riveted base which is smooth and has a flat profile for placement on a flat surface or on another handcuff.

A flat is provided on the outer surface of the bow for lining up a point of contact of the bow with a wrist and provides smooth movement of the bow relative to the cheek plate assembly when placing the handcuff on a wrist.

The lockset assembly is removable to enable a damaged or non-functioning lockset assembly to be replaced without requiring a complete replacement of the set of handcuffs. The lockset assembly provides a simple lock mechanism with a lock bar having a locksetting slot which can be manipulated by an actuating pin on a conventional handcuff key or by the conventional handcuff key for putting the lock mechanism in a double or single lock position. Then two keyways are provided on either side of the base frame to enable a key to be inserted into the handcuff from either side of the handcuff.

The interacting parts of the lock mechanism, namely, the legs on the lock bar pawl and the spaces or cavities on the slidable double lock bar are constructed and arranged so that a key inserted through either keyway on either side of the base frame can only be rotated in one direction. Further, when the key is inserted, it is first rotated to move the double lock bar from a double lock position into a single lock position and then to move legs or fingers depending from the pawl toward the double lock bar to completely disengage the pawl from the teeth on a teeth track portion of the bow.

A deflectable detent is provided on the housing for the lockset assembly to enable the lockset assembly to be releasably locked in place and then by deflection of the deflectable detent assembly out of a locking notch in the base frame, the lockset assembly can be removed and replaced.

A two-way swivel is provided which enables an eyelet of a swivel to be placed on a chain link which is then welded solid before a pin of the swivel is inserted into a swivel cup mounted to the base frame of the cheek plate assembly. The swivel cup is swaged to the base frame to provide a solid but rotatable connection between the swivel pin of the swivel and the swivel cup when the swivel cup is swaged over the swivel pin to create a strong swivel connection.

Finally, rounded detents are formed in the side plates of the base frame and positioned to engage in track grooves on either side of the track portion of the bow for smoothly guiding the bow through the cheek assembly.

Further, it will be understood that the set of handcuffs of the present invention can be modified without departing from the teachings of the invention. Accordingly, the scope of the invention is only to be limited as necessitated by the accompanying claims.

We claim:

1. In a handcuff comprising a bow pivotally connected to and between cheek plates of a cheek plate assembly that also includes a base frame containing a lock mechanism, the improvement residing in the lock mechanism comprising a lockset disposed in said base frame, said base frame having opposite sides and a keyway disposed in each one of said opposite sides for receiving a key inserted from either one of said opposite sides of said base frame where the keyways are laterally offset, one from another, in the base frame, the lockset having a lock bar pawl with a set of teeth for engaging the bow on a first side and a pair of ledges on a second, opposing side of the lock bar pawl, each in alignment with a respective keyway that disengages the teeth from the bow when the key is rotated within either one of the keyways and activates the respective ledge.

2. The handcuff of claim 1 wherein the lockset further comprising a lockset assembly having a housing, a slideable lock bar in said housing, a pivotable lock bar pawl in said housing and having teeth thereon which are engageable with teeth on a tooth track portion of the bow of the handcuff, said lock bar having on a side thereof facing said pawl, a first cavity, a first step or land, a second cavity, and a second step or land, and said lock bar pawl having on a side facing said lock bar, spaced apart, first and second legs, said legs being opposite said cavities in a single lock position of said lock bar where the bow can move in a forward ratcheting direction through the cheek plate assembly but not rearwardly and said legs being opposite and adjacent said steps or lands in a double lock position of said lock bar where the bow, once ratcheted into the cheek plate assembly, cannot move in either direction.

3. The lockset assembly of claim 2, wherein said lock bar has a lock setting slot for receiving an actuating pin through either one of opposite lock slots in said base frame, whereby the actuating pin can be moved against one side of said slot for moving said lock bar from the single lock position to the double lock position.

4. The lockset assembly of claim 2, wherein said housing has aligned openings on either side thereof which are aligned with opposite lock slots in said base frame for receiving the actuating pin from either side of the handcuff for moving said lock bar.

5. The lockset assembly of claim 2, wherein said lock bar pawl has several teeth on an outer surface at one end of said pawl and a rounded pivot end at the other end of said pawl, said first and second legs being spaced apart and extending toward said lock bar and a spring positioned between said lock bar pawl and said lock bar and at a location between said pivot end and said first leg.

6. The lockset assembly of claim 2, wherein said housing has on one side a first key opening on a first key axis and on the other side a second key opening on a second key axis parallel spaced from said first key axis, each opening being configured to receive a key with a single tooth, said first axis extending into a space adjacent said first leg and said second axis extending into a space adjacent said second leg, such that when a key is inserted in either opening a tooth of the key will be adjacent said first or second leg and rotation of the tooth of the key in one rotational direction only will result in engagement of the tooth of the key with said lock bar and movement of said lock bar to the single lock position.

7. The lockset assembly of claim 6 wherein said pivot end of said pawl is received in a rounded cavity in said housing and bears and pivots about a wall of said rounded cavity and movement of said pawl toward said rounded cavity is prevented by said wall such the rotation of the tooth in the opposite rotational direction is stopped by said first or second leg of said pawl whereby the key can only be rotated in one direction on either said first or second key axis.

8. The lockset assembly of claim 6 wherein said housing has a first locating pin therein on one side of said housing and on said first key axis and a second locating pin therein on the other side of said housing and on said second axis.

9. The lockset of claim 6 wherein each leg has an outer end which can engage one of said steps or lands and each leg has a laterally extending ledge, an arcuate wall that extends from said laterally extending ledge toward said pawl such that after the tooth on the key is rotated to move said steps or lands away from said outer ends of said legs and to move said first and second spaces or cavities into alignment with said outer ends of said legs, the tooth on the key will move adjacent said arcuate wall and into engagement with one of said laterally extending ledges to move said leg toward said lock bar and into said first or second space or cavity thereby moving the teeth on said pawl out of engagement with the teeth on the track portion of the bow to fully unlock said pawl from the bow.

10. The lockset assembly of claim 2 wherein said housing comprise an open housing shell and a cover, said open housing shell having a first cavity portion for receiving said lock bar and a second cavity portion for receiving said lock bar pawl.

11. The lockset assembly of claim 10 wherein at least one of said housing shell or said cover has a key locating pin extending from an inside wall thereof toward said cover or said housing shell, said locating pin receiving a hollow cylindrical end of a handcuff key.

12. The lockset assembly of claim 11 wherein one of said cover or said housing shell has a deflectable detent formed in a wall thereof which is adapted to releasably latch in an opening in one of two side plates of the base frame.

13. The lockset assembly of claim 12 wherein the other of said housing shell or cover has a notch on an inside wall thereof opposite said deflectable detent and into which said deflectable detent can be moved for releasing said housing from the base frame.

14. The lockset assembly of claim 3, wherein said lock bar is color coded so that said lock setting slot can easily be seen through said opposite lock slots in either side of said base frame.

15. A lock set assembly for a handcuff comprising a housing, a slideable lock bar in said housing, a pivotable lock bar pawl in said housing and having teeth thereon which are engageable with teeth on a tooth track portion of a bow of a handcuff, a spring between said lock bar and said pawl, said lock bar having on a side thereof facing said pawl, a first cavity, a first step or land, a second cavity, and a second step or land, and said lock bar pawl having on a side facing said lock bar, spaced apart, first and second legs, said legs being opposite said cavities in a single lock position of said lock bar where the bow can move in a forward ratcheting direction through said lock set assembly but not rearwardly and said legs being opposite and adjacent said steps or lands in a double lock position of said lock bar where the bow, once ratcheted into said lock set assembly, cannot move in either direction, said housing having on one side a first key opening on a first key axis and on the other side a second key opening on a second key axis parallel spaced from said first key axis, each opening being configured to receive a key, said first axis extending into a space adjacent said first leg and said second axis extending into a space adjacent said second leg, such that when a key is inserted in either opening, the key will be adjacent said first or second leg and rotation of the key in one rotational direction only will result in engagement of the key with said lock bar and movement of said lock bar to the single lock position.

16. The lock set of claim 15 wherein said spring acts between said lock bar pawl and said lock bar and said lock set including a lock spring tip which is positioned at an end of said spring and which acts against said lock bar, and said lock bar having at least one notch or depression and said spring tip is snap-fittingly received in said notch or depression to latch releasably said lock bar against movement.

17. The lock set of claim 15 wherein said spring acts between said lock bar pawl and said lock bar and said lock bar is movable between a single lock position where a bow can ratchet past said lock bar pawl in a forward handcuff locking direction and a double lock position where the bow can not move in either a forward direction or a backward direction and said lock set including a lock spring tip which is positioned at an end of said spring and which acts against said lock bar, said lock bar having spaced first and second notches or depressions and said lock spring tip is snap-fittingly received in said first notch or depression in a single lock position of said lock bar and in said second notch or depression in a double lock position of said lock bar.

18. The lockset assembly of claim 15, wherein said lock bar has a lock setting slot for receiving an actuating pin through either one of opposite lock slots in said housing, whereby the actuating pin can be moved against one side of said slot for moving said lock bar from the single lock position to the double lock position.

19. The lockset assembly of claim 18 wherein said lock slots are aligned with opposite lock slots in a base frame of a cheek plate assembly of the handcuff for receiving the actuating pin from either side of the handcuff for moving said lock bar.

20. The lockset assembly of claim 15 wherein said pivot end of said pawl is received in a rounded cavity in said hosing and bears and pivots about a wall of said rounded cavity and movement of said pawl toward said rounded cavity is prevented by said wall such the rotation of the tooth in the opposite rotational direction is stopped by said first or second leg of said pawl whereby the key can only be rotated in one direction on either said first or second key axis.

21. The lockset assembly of claim 15 wherein said housing has a first locating pin therein on one side of said housing and on said first key axis and a second locating pin therein on the other side of said housing and on said second axis.

22. The lockset assembly of claim 15 wherein each leg has an outer end which can engage one of said steps or lands and each leg has a laterally extending ledge, an arcuate wall that extends from said laterally extending ledge toward said pawl such that after the tooth on the key is rotated to move said steps or lands away from said outer ends of said legs and to move said first and second spaces or cavities into alignment with said outer ends of said legs, the tooth on the key will move adjacent said arcuate wall and into engagement with one of said laterally extending ledges to move said leg toward said lock bar and into said first or second space or cavity thereby moving the teeth on said pawl out of engagement with the teeth on the track portion of the bow to fully unlock said pawl from the bow.

23. A handcuff comprising a bow pivotally connected to and between cheek plates of a cheek plate assembly that also includes a base frame containing a lockset, said lockset having opposite sides, and said and being disposed in said base frame having opposite sides, and said base frame and said lockset having a keyway disposed in each one of said opposite sides thereof for receiving a key inserted from either one of said opposite sides of said base frame for operating said lockset assembly where the keyways are laterally offset, one from another, in the base frame, the lockset having a lock bar pawl with a set of teeth for engaging the bow on a first side and a pair of ledges on a second, opposing side of the lock bar pawl, each in alignment with a respective keyway that disengages the teeth from the bow when the key is rotated within either one of the keyways and activates the respective ledge.

24. A lockset assembly for a handcuff of the type comprising a bow pivotally connected to and between cheek plates of a cheek plate assembly that also includes a base frame having opposite sides and a lockset disposed therein, said lockset having opposite sides and a keyway disposed in each opposite side thereof for receiving a key inserted from and through either one of the opposite sides of the base frame and into said lockset for operating said lockset where the keyways are laterally offset, one from another in the base frame, the lockset having a lock bar pawl with a set of teeth for engaging the bow on a first side and a pair of ledges, on a second opposing side of the lock bar pawl each in alignment with a respective keyway that disengages the teeth from the bow when the key is rotated within either one of the keyways and engages the respective ledge.

25. The handcuff of claim 23 wherein the lockset further comprises a lockset assembly and where one keyway on one side of said base frame and lockset assembly has a first axis traversing said base frame and lockset assembly and the other keyway on the other side of said base frame and lockset assembly has a second axis traversing said base frame and lockset assembly with said second axis being generally parallel to said first axis.

26. The handcuff of claim 24 wherein the lockset further comprises a lockset assembly and where one keyway on one side of said lockset assembly has a first axis traversing said lockset assembly and the other keyway on the other side of said lockset assembly has a second axis traversing said lockset assembly with said second axis being generally parallel to said first axis.

27. A lockset assembly for a handcuff, said lockset assembly comprising a housing, a slideable lock bar in said housing, a pivotable lock bar pawl in said housing and having teeth thereon which are engageable with teeth on a tooth track portion of the bow of a handcuff, said lock bar having on a side thereof facing said pawl, a first cavity, a first step or land, a second cavity, and a second step or land, and said lock bar pawl having on a side facing said lock bar, spaced apart, first and second legs, said legs being opposite said cavities in a single lock position of said lock bar where the bow can move in a forward ratcheting direction through the cheek plate assembly but not rearwardly and said legs being opposite and adjacent said steps or lands in a double lock position of said lock bar where the bow, once ratcheted into the cheek plate assembly, cannot move in either direction.

28. The lockset assembly of claim 27, wherein said housing has on one side a first key opening on a first key axis and on the other side a second key opening on a second key axis parallel spaced from said first key axis, each opening being configured to receive a key with a single tooth, said first axis extending into a space adjacent said first leg and said second axis extending into a space adjacent said second leg, such that when a key is inserted in either opening a tooth of the key will be adjacent said first or second leg, and rotation of the tooth of the key in one rotational direction only will result in engagement of the tooth of the key with said lock bar and movement of said lock bar to the single lock position.

* * * * *